US010935273B2

(12) United States Patent
Cho et al.

(10) Patent No.: US 10,935,273 B2
(45) Date of Patent: Mar. 2, 2021

(54) AIR CONDITIONER

(71) Applicant: Samsung Electronics Co., Ltd., Suwon-si (KR)

(72) Inventors: Sung June Cho, Suwon-si (KR); Kwon Jin Kim, Suwon-si (KR); Sung Jae Kim, Suwon-si (KR); Seon Uk Na, Suwon-si (KR); Yeon Seob Yun, Suwon-si (KR); Young Uk Yun, Suwon-si (KR); Kyeong Ae Lee, Suwon-si (KR); Byung Han Lim, Suwon-si (KR); Jong Kweon Ha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 78 days.

(21) Appl. No.: 16/222,237

(22) Filed: Dec. 17, 2018

(65) Prior Publication Data

US 2019/0186778 A1 Jun. 20, 2019

(30) Foreign Application Priority Data

Dec. 27, 2017 (KR) ..... 10-2017-0181213

(51) Int. Cl.
*F24F 11/81* (2018.01)
*F24F 1/0014* (2019.01)
(Continued)

(52) U.S. Cl.
CPC ..... *F24F 11/81* (2018.01); *F24F 1/0014* (2013.01); *F24F 1/06* (2013.01); *F24F 11/79* (2018.01);
(Continued)

(58) Field of Classification Search
CPC .. F24F 11/81; F24F 13/20; F24F 13/10; F24F 1/0014; F24F 11/79; F24F 1/06;
(Continued)

(56) References Cited

U.S. PATENT DOCUMENTS

2014/0099875 A1* 4/2014 Kim ..... F24F 1/0011 454/322

FOREIGN PATENT DOCUMENTS

CN 101430113 5/2009
CN 103175260 6/2013
(Continued)

OTHER PUBLICATIONS

International Search Report and Written Opinion of the International Searching Authorities dated Apr. 23, 2019 in International Patent Application No. PCT/KR2018/016789.
(Continued)

*Primary Examiner* — Ana M Vazquez
(74) *Attorney, Agent, or Firm* — Staas & Halsey, LLP

(57) ABSTRACT

An air conditioner includes a housing having first and second suction ports; a heat exchanger configured to exchange heat with air brought in through the first suction port; a first discharging port configured to discharge the heat-exchanged air; a second discharging port configured to discharge air brought in through the second suction port to be mixed with air discharged from the first discharging port at outside of the housing; a discharging door having a plurality of discharging holes, through which air directed to the first discharging port is discharged out of the housing, and selectively opening the second discharging port by movement operation of the discharging door.

20 Claims, 20 Drawing Sheets

(51) Int. Cl.

| | |
|---|---|
| ***F25B 30/02*** | (2006.01) |
| ***F24F 11/79*** | (2018.01) |
| ***F24F 1/06*** | (2011.01) |
| ***F24F 13/20*** | (2006.01) |
| ***F24F 13/10*** | (2006.01) |

(52) U.S. Cl.
CPC ..... *F24F 13/10* (2013.01); *F24F 13/20* (2013.01); *F25B 30/02* (2013.01); *F24F 2013/205* (2013.01); *F25B 2600/25* (2013.01)

(58) Field of Classification Search
CPC ..... F24F 2013/1446; F24F 13/1426; F24F 13/30; F24F 2013/205; F24F 1/0011; F25B 30/02; F25B 2600/25
See application file for complete search history.

(56) References Cited

FOREIGN PATENT DOCUMENTS

| | | | |
|---|---|---|---|
| CN | 204962975 | | 1/2016 |
| CN | 106560660 | | 4/2017 |
| JP | 7-99265 | | 4/1995 |
| JP | 2005-238920 | | 9/2005 |
| JP | 2015-45500 | | 3/2015 |
| KR | 10-1999-0016577 | | 3/1999 |
| KR | 20000055145 A | * | 9/2000 |
| KR | 10-2003-0063885 | | 7/2003 |
| KR | 10-2005-0118948 | | 12/2006 |
| KR | 20-2009-0000520 | | 1/2009 |
| KR | 10-1022218 | | 3/2011 |
| KR | 10-2014-0037985 | | 3/2014 |
| KR | 10-1393725 | | 5/2014 |
| KR | 10-2015-0014225 | | 2/2015 |
| KR | 10-2016-0051095 | | 5/2016 |
| KR | 10-2017-0010293 | | 1/2017 |

OTHER PUBLICATIONS

Chinese Office Action dated Jul. 29, 2020 in Chinese Patent Application No. 201811612209.8.
Extended European Search Report dated Dec. 10, 2020 in European Patent Application No. 18894724.6.

* cited by examiner

AIR CONDITIONER

CROSS-REFERENCE TO RELATED APPLICATIONS

This application is based on and claims priority under 35 U.S.C. § 119 to Korean Patent Application No. 10-2017-0181213 filed on Dec. 27, 2017, in the Korean Intellectual Property Office, the disclosure of which is incorporated by reference herein in its entirety.

BACKGROUND

1. Field

The disclosure relates to air conditioners, and more particularly, to an air conditioner employing different air discharging methods.

2. Description of Related Art

In general, an air conditioner is a device for controlling temperature, humidity, airflows, airflow distribution, etc., to be comfortable for human activities and simultaneously, eliminating dust or something in the air by using refrigeration cycles. The refrigeration cycle involves a compressor, a condenser, an evaporator, an expansion valve, and a blower fan as the primary elements.

The air conditioners may be classified into split air conditioners with indoor and outdoor units separately installed, and packaged air conditioners with indoor and outdoor units installed together in a single cabinet. The indoor unit of the split air conditioner includes a heat exchanger for exchanging heat of the air sucked into the panel, and a blower fan for sucking the room air into the panel and blowing out the air back into the room.

With the indoor unit of a traditional air conditioner, when the user is directly exposed to the discharged air, he/she might feel cold and unpleasant, and on the contrary, when he/she is not exposed to the discharged air, he/she might feel hot and unpleasant.

SUMMARY

Additional aspects will be set forth in part in the description which follows and, in part, will be apparent from the description, or may be learned by practice of the presented embodiments.

The present disclosure provides an air conditioner employing different air discharging methods.

The present disclosure also provides an air conditioner capable of cooling or heating the room at a minimum wind velocity at which the user may feel pleasant.

The present disclosure also provides an air conditioner capable of providing natural wind that has not exchanged heat.

The present disclosure also provides an air conditioner capable of providing a mixture of heat-exchanged air and room air.

The present disclosure also provides an air conditioner having a flow path in which heat-exchanged air flows and a flow path in which natural wind flows, the flow paths being effectively arranged in the air conditioner.

In accordance with an aspect of the present disclosure, an air conditioner is provided. The air conditioner includes a housing having first and second suction ports; a heat exchanger configured to exchange heat with air brought in through the first suction port; a first discharging port configured to discharge the heat-exchanged air; a second discharging port configured to discharge air brought in through the second suction port to be mixed with air discharged from the first discharging port at outside of the housing; a discharging door having a plurality of discharging holes, through which air directed to the first discharging port is discharged out of the housing, and selectively opening the second discharging port by movement operation of the discharging door.

The discharging door may move between a closing position to close the second discharging port, and an opening position to open the second discharging port.

The movement may include at least one of parallel movement and turning movement.

The air conditioner may further include an interval maintainer member configured to maintain the second discharging port to have less than a predetermined width when the discharging door moves from the closing position to the opening position.

The interval maintainer member may be arranged on an inner side of the housing to be moved with the discharging door.

The second discharging port may be formed between the housing and a part of the interval maintainer member near a rear side of the discharging door.

The discharging door may open at least some of the second discharging port at the opening position as at least one of top, bottom, left and right sides of the discharging door is separated from the housing.

The air conditioner may further include a movement member coupled to the discharging door to move the discharging door, wherein the movement member includes a pinion gear rotationally coupled to the housing; and a rack gear coupled to a rear side of the discharging door to move the discharging door, the rack gear converting turning movement of the pinion gear to linear movement.

The second discharging port may be formed between a rear side of the discharging door and the housing.

The discharging door may include a curved guide part formed on the rear side of the discharging door to guide air directed to the second discharging port.

The discharging door may include a curved edge part formed for air flowing along the curved guide part to be directed to a front of the discharging door, the curved edge part coupled to the curved guide part and swollen outward from an edge of the discharging door.

The discharging door may include a discharging panel having the plurality of discharging holes formed thereon; and a panel connector extending from the discharging panel and configured to be movable relative to the housing.

The air conditioner may further include a first flow path in which air brought in through the first suction port passes the heat exchanger and flows toward the first discharging port; a second flow path in which air brought in through the second suction port flows to the second discharging port, the second flow path separated from the first flow path; and a middle member fixedly arranged inside the housing and located between the first and second flow paths, wherein the panel connector may separate the first and second flow paths at the opening and closing positions together with the middle member.

The panel connector may be moved relative to the middle member while keeping in contact with the middle member.

The plurality of discharging holes may be formed to discharge air out of the housing at lower speed than flow speed of the air in the first flow path, and the discharging panel may constitute the front of the air conditioner and the plurality of discharging holes are uniformly distributed on the discharging panel.

The air conditioner may further include first and second blower units arranged in the first and second flow paths, respectively, to suck in outside air from the first and second suction ports and move the air to be directed to the first and second discharging ports, respectively.

The second discharging port may be is arranged to be adjacent to one side of the discharging door and formed to be long in a longitudinal direction corresponding to the one side, and the air conditioner may further include a plurality of blades arrayed in the longitudinal direction for air discharged from the second discharging port to be uniformly discharged in the longitudinal direction.

In accordance with an aspect of the present disclosure, an air conditioner is provided. The air conditioner includes a housing having first and second flow paths separated from each other; a heat exchanger arranged in the housing to exchange heat with air flowing in the first flow path; and a discharging door movably arranged on a front of the housing, wherein the discharging door may include a discharging panel having a plurality of discharging holes formed to discharge air at lower speed than flow speed of the air in the first flow path and constituting a front of the discharging door; and a panel connector extending backward from the discharging panel and forming a discharging port with the housing, through which air flowing in the second flow path is discharged.

The discharging door may move between a closing position to close the discharging port, and an opening position to open the discharging port, and the housing may include an interval maintainer member configured to maintain the discharging port to have less than a predetermined width when the discharging door moves from the closing position to the opening position.

In accordance with an aspect of the present disclosure, an air conditioner is provided. The air conditioner includes a housing having first and second suction ports; a heat exchanger arranged in the housing; a first discharging port coupled to the first suction port through a first flow path and discharging air that exchanges heat while passing the heat exchanger; a second discharging port coupled to the second suction port through a second flow path separated from the first flow path; and a discharging door having a plurality of discharging holes formed thereon to discharge air directed to the first discharging port out of the housing, wherein the second discharging port is selectively opened by movement of the discharging door.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
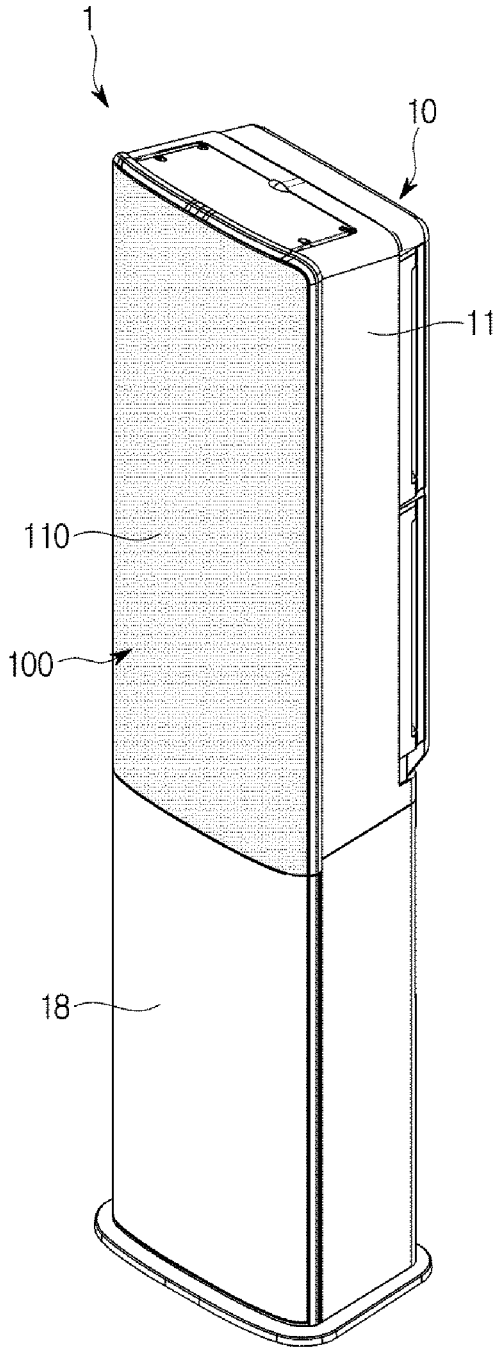
FIG. 1 is a perspective view of an air conditioner, according to an embodiment of the present disclosure.

Embodiments and features as described and illustrated in the present disclosure are only examples, and various modifications thereof may also fall within the scope of the disclosure.

Throughout the drawings, like reference numerals refer to like parts or components.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or chamber discussed below could be termed a second element, component, region, layer or section without departing from the teachings of the present disclosure. Descriptions shall be understood as to include any and all combinations of one or more of the associated listed items when the items are described by using the conjunctive term "~ and/or ~," or the like.

A refrigeration cycle of an air conditioner (AC) is comprised of a compressor, a condenser, an expansion valve, and an evaporator. A refrigeration cycle involves a series of processes having compression, condensing, expansion, and evaporation to supply conditioned air that has exchanged heat with a refrigerant.

A compressor compresses a gas refrigerant into a high temperature and high pressure state and discharges the compressed gas refrigerant, and the discharged gas refrigerant flows into a condenser. A condenser condenses the compressed gas refrigerant into a liquid state, releasing heat to the surroundings.

An expansion valve expands the high temperature and high pressure liquid refrigerant condensed by the condenser to low pressure liquid refrigerant. An evaporator evaporates the refrigerant expanded by the expansion valve and returns the low temperature and low pressure gas refrigerant to the compressor. The evaporator attains a cooling effect using latent heat of vaporization of the refrigerant to exchange heat with an object to be cooled. Through this refrigeration cycle, the air conditioner may condition air in a room.

An outdoor unit of the air conditioner refers to a part of the air conditioner comprised of the compressor and an outdoor heat exchanger of the refrigeration cycle. The indoor unit of the air conditioner may include an indoor heat exchanger, and the expansion valve may be located in any of the indoor unit and the outdoor unit. Indoor and outdoor heat exchangers serve as the condenser or the evaporator. When the indoor heat exchanger is used as the condenser, the air conditioner becomes a heater, and when the indoor heat exchanger is used as the evaporator, the air conditioner becomes a cooler.

Reference will now be made in detail to embodiments, examples of which are illustrated in the accompanying drawings, wherein like reference numerals refer to the like elements throughout.

Figure 2:
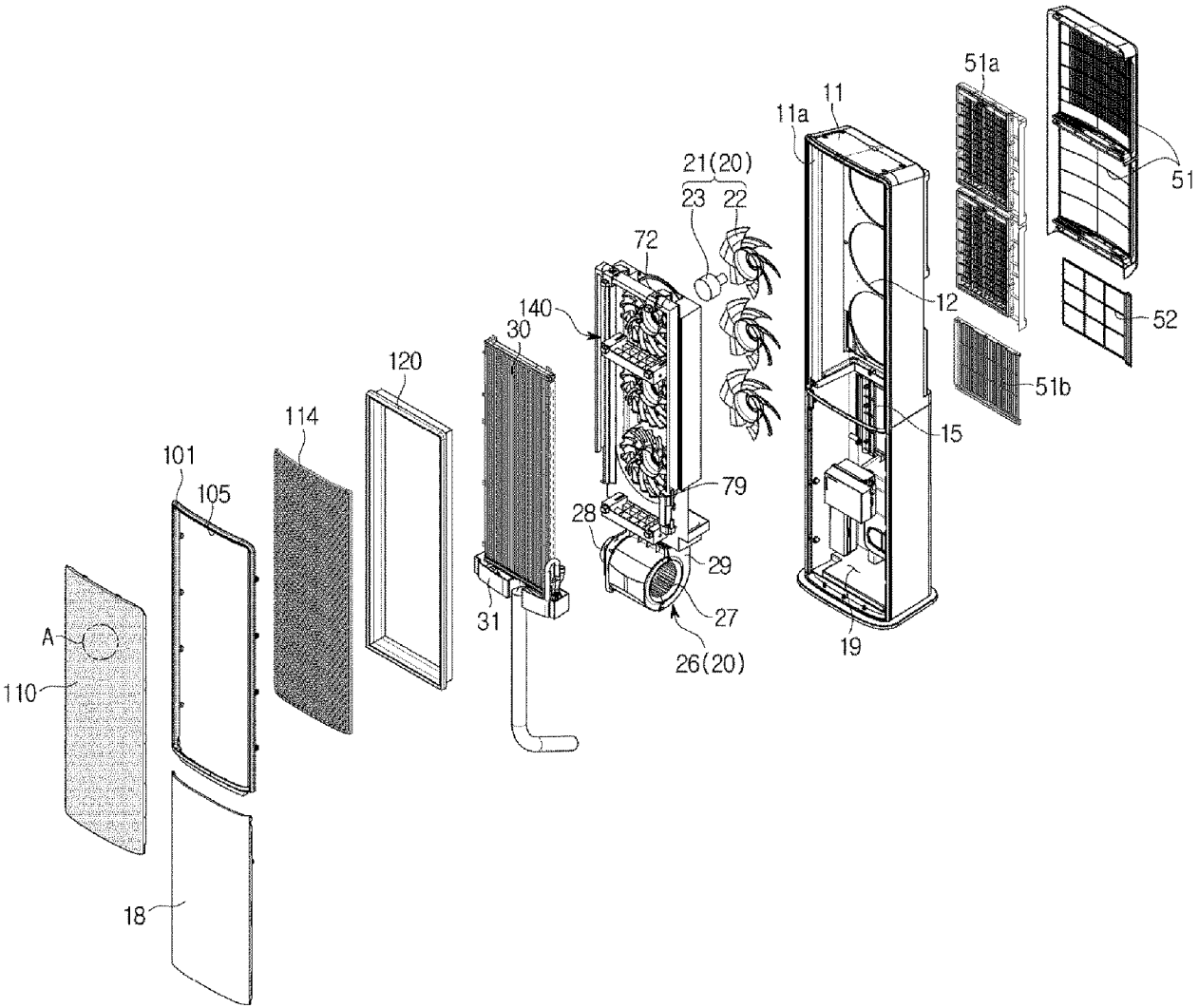
FIG. 2 is an exploded view of an air conditioner, according to an embodiment of the present disclosure.
Figure 3:
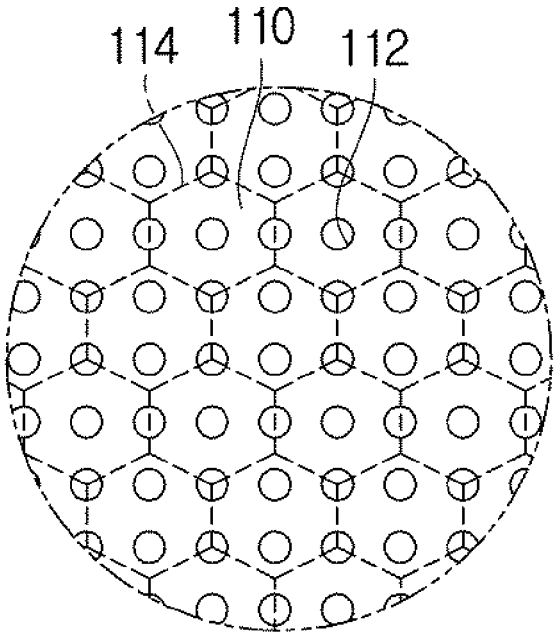
FIG. 3 is an enlarged view of 'A' of FIG. 2.
Figure 4:
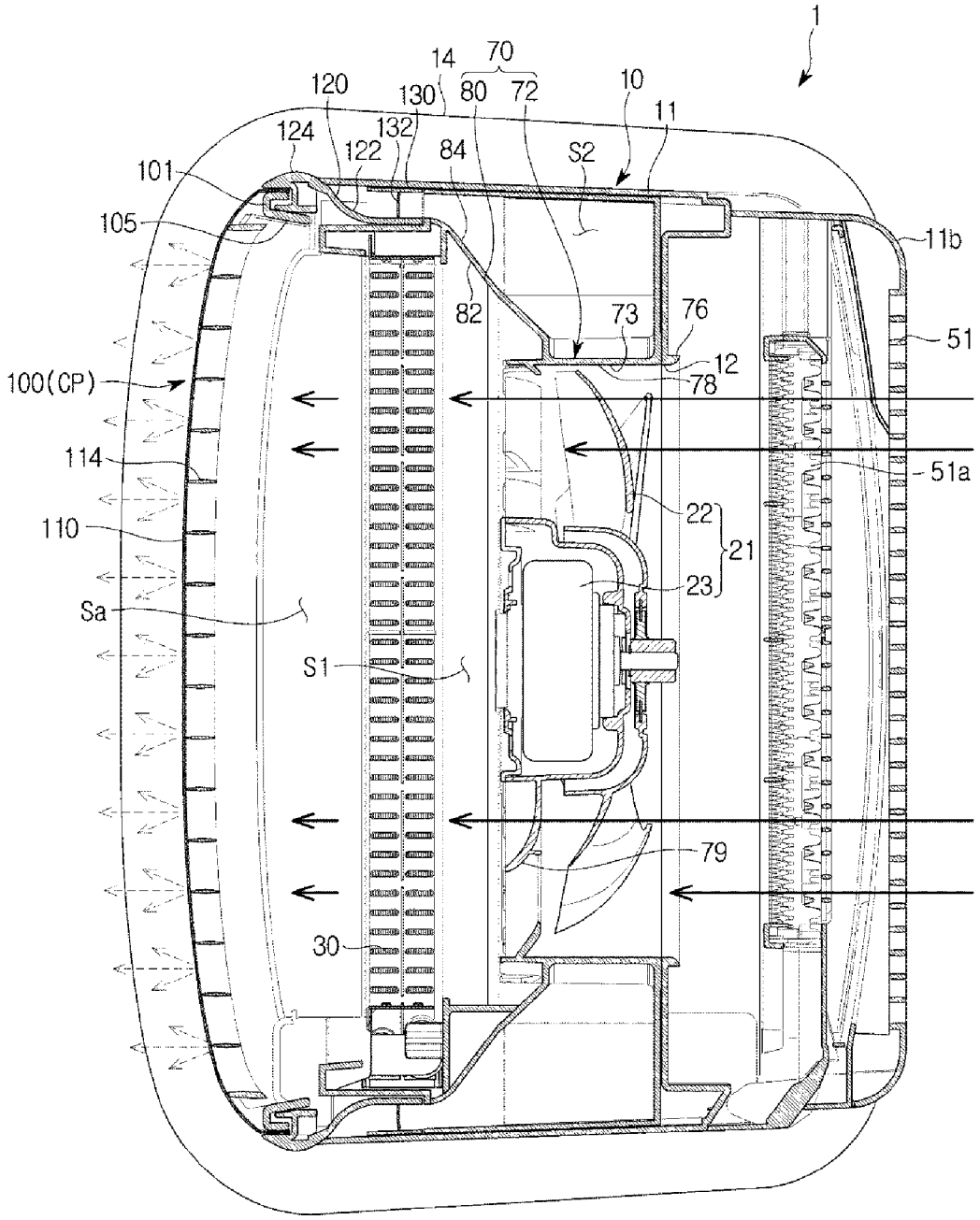
FIGS. 4 and 5 are cross-sectional views representing air flows of an air conditioner operating in a first mode, according to an embodiment of the present disclosure.

FIG. 1 is a perspective view of an air conditioner, according to an embodiment of the present disclosure, FIG. 2 is an exploded view of an air conditioner, according to an embodiment of the present disclosure, FIG. 3 is an enlarged view of 'A' of FIG. 2, and FIG. 4 is a cross-sectional view of an air conditioner, according to an embodiment of the present disclosure.

Referring to FIGS. 1 and 2, an air conditioner 1 may include a housing 10 forming the exterior, a blower unit 20 for circulating air into or out of the housing 10, and a heat exchanger 30 for exchanging heat with the air brought into the housing 10.

The housing 10 may include a main housing 11 having the blower unit 20 and the heat exchanger arranged therein, and a discharging door 100 movably mounted on the main housing 11. The housing 10 may include a first suction port 12, a second suction port 15, a first discharging port 105, and a second discharging port 13 (see FIG. 6). At the bottom end of the heat exchanger 30, a drain member 31 may be arranged to collect condensate water produced in the heat exchanger 30.

The main housing 11 may form at least some of the back, both sides, top, and bottom of the air conditioner 1. The main housing 11 has an open front, and the discharging door 100 may be arranged on the open front.

For example, the discharging door 100 may be arranged on the upper front of the main housing 11, and a front panel 18 may be arranged on the lower front of the main housing 11. The front panel 18 may cover at least some of the open lower front of the main housing 11.

The discharging door 100 may include a door frame 101. The door frame 101 may be formed to have a cavity corresponding to the area of the heat exchanger 30 and may constitute the frame of the discharging door 100. The first discharging port 105 may be formed on the door frame 101. The first discharging port 105 may be arranged on the front of the housing 10. The first discharging port 105 may penetrate the door frame 101. The first door frame 101 may constitute the first discharging port 105. The first discharging port 105 may be arranged at a position roughly facing the first suction port 12. Specifically, the first discharging port 105 may be arranged on the front of the housing 10 and the first suction port 12 may be arranged on the back of the housing 10. The air that has exchanged heat (hereinafter, called 'heat-exchanged air') in the housing 10 may be discharged out of the housing 10 through the first discharging port 105 and a plurality of discharging holes 112. The first discharging port 105 may discharge the air brought in through the first suction port 12.

The first suction port 12 may be formed on the main housing 11. The first suction port 12 may penetrate the rear side of the main housing 11. The first suction port 12 may be formed on the upper rear side of the main housing 11. Outside air may be brought into the housing 10 through the first suction port 12.

Although there are three suction ports 12 illustrated in FIG. 2, the number of the first suction ports 12 is not limited thereto, but may vary as needed. The first suction port 12 has a circular shape in FIG. 2, but the shape of the first suction port 12 is not limited thereto, and may vary as needed.

The second suction port 15 may be formed on the main housing 11. The second suction port 15 may penetrate the rear side of the main housing 11. The second suction port 15 may be formed on the lower rear side of the main housing 11. The second suction port 15 may be formed under the first suction port 12. Outside air may be brought into the housing 10 through the second suction port 15.

Like the first suction port 12, the second suction port 15 may be variously implemented in number and/or shape as needed.

Apart from the first discharging port 105, the air conditioner 1 may include the second discharging port 13 distinguished from the first discharging port 105. The second discharging port 13 (see FIG. 6) may be formed on the main housing 11. Specifically, the second discharging port 13 may be formed between the discharging door 100 and the main housing 11. The second discharging port 13 may be arranged to be adjacent to the first discharging port 105. The second discharging port 13 may be arranged on at least one side of the main housing 11. The second discharging port 13 may be formed on the side of the main housing 11. The second discharging port 13 may be formed at an upper portion of the side of the main housing 11. The second discharging port 13 may be formed on both sides of the main housing 11 corresponding to some parts of the main housing 11.

The second discharging port 13 may extend in the vertical direction of the main housing 11. The air that has not exchanged heat (hereinafter, also called 'non-heat-exchanged air') inside the housing 10 may be discharged out of the housing 10 through the second discharging port 13. The second discharging port 13 may be provided to discharge the air brought in through the second suction port 15.

The main housing 11 may be formed in a single body or in two separate bodies, i.e., upper and lower bodies. In an embodiment, the main housing 11 refers to the latter one, i.e., a combination of the upper and lower bodies.

The second discharging port 13 may be formed to have the air to be discharged from the second discharging port 13 mixed with the air discharged from the first discharging port 105.

The second discharging port 13 may be opened or closed by the discharging door 100. The second discharging port 13 may be formed between the rear side or a side of the discharging door 100 and the main housing 11. The outside air brought in through the first suction port 12 may pass the heat exchanger 30 and may be discharged out of the main housing 10 through the discharging door 100 past the first discharging port 105.

The discharging door 100 may include the plurality of discharging holes 112 through which air directed to the first discharging port 105 is discharged out of the housing 10. The discharging door 100 may selectively open the second discharging port 13 based on its movement operation. The movement operation of the discharging door 100 may include at least one of parallel movement and turning movement.

The discharging door 100 may include a discharging panel 110 and a panel connector 120.

The discharging panel 110 is provided to form at least some of the front of the air conditioner 1. In other words, the discharging panel 110 may be formed to cover the front of the main housing 10. As shown in FIG. 3, the plurality of discharging holes 112 are formed on the discharging panel 110, and the air directed to the first discharging port 105 is distributed to the plurality of discharging holes 112 and discharged out of the main housing 10. Because the area of the discharging hole 112 is very small as compared with the area of the first discharging port 105, the air flowing in a first flow path S1 slows down while passing the plurality of discharging holes 112 and is discharged to the outside at the reduced speed. Specifically, because the diameter of the discharging hole 112 is very small as compared with the first discharging port 105 or a discharging space Sa formed between the discharging panel 110 and the heat exchanger 30, the air that has passed the heat exchanger 30 and is directed to the discharging space Sa has flow resistance while passing the plurality of discharging holes 112, which slows down the air flow rate (or wind speed or speed), and is discharged to the outside of the air conditioner 1 at the reduced speed.

As the heat-exchanged air is discharged out of the air conditioner 1 at the reduced speed after passing through the plurality of discharging holes 112, as described above, the user may not be directly exposed to the air and feel pleasant in the indoor space.

The plurality of discharging holes 112 may be formed to penetrate the inner and outer surfaces of the discharging panel 110. The plurality of discharging holes 112 may each have a circular shape, but the shape of the plurality of discharging holes 112 is not limited thereto. The plurality of discharging holes 112 may be uniformly distributed on the discharging panel 110. The plurality of discharging holes 112, however, are not limited thereto, but may be distributed in some portion of the discharging panel 110. Alternatively, the discharging holes 112 may be distributed in first and second regions of the discharging panel 110 and may be distributed more densely in the first region than in the second region.

The panel connector 120 may be formed to support the discharging panel 110. The panel connector 120 may be arranged along at least some of the edges of the discharging panel 110. The panel connector 120 may extend from the edge of the discharging panel 110 to the back of the discharging panel 110 to prevent mixture of the air passing the first flow path S1 and the air passing a second flow path S2. In other words, the panel connector 120 may constitute at least some of a structure that divides the first and second flow paths S1 and S2 in terms of the movement of the discharging door 100.

The panel connector 120 may be provided to move relative to the housing 10. Specifically, the panel connector 120 may make relative movement to a middle member 70 in terms of the movement of the discharging door 100. The panel connector 120 may be formed to keep in contact with the middle member 70 even with the movement of the discharging door 100, thereby serving as an extension of the middle member 70.

The panel connector 120 may include a curved guide part 122. The curved guide part 122 may be formed on the rear side of the discharging door 100. The curved guide part 122 is formed to guide the air moving toward the second discharging port 13 such that the air moving toward the second discharging port 13 is mixed with the air discharged from the first discharging port 105.

The curved guide part 122 may guide the air discharged from the second discharging port 13 according to the Coanda effect. Specifically, the air flowing in the second flow path S2 is discharged to the second discharging port 13 along the curved guide part 122 to a direction in which the air may be mixed with air discharged from the first discharging port 105.

When the second discharging port 13 is arranged on the side of the housing 10 and the first discharging port 105 is arranged on the front of the housing 10, the curved guide part 122 may be formed to guide the air discharged through the second discharging port 13 to the front.

The discharging door 100 may include a curved edge part 124. The curved edge part 124 may be formed to extend from the curved guide part 122 such that the air flowing along the curved guide part 122 is directed to the front of the discharging door 100. The curved edge part 124 may be formed at the edge of the discharging door 100 while being connected to the curved guide part 122. The curved edge part 124 may be formed to occupy at least some portion of the edge of the discharging door 100, in which case the curved edge part 124 may be formed to protrude outward from the edge of the discharging door 100.

The discharging door 100 may include a support frame 114.

The support frame 114 may be arranged on the rear side of the discharging panel 110. The support frame 114 may enhance durability of the discharging panel 110 by supporting the rear side of the discharging panel 110. The support frame 114 may have a plurality of cavities for the air flowing in the first flow path S1 to be discharged out of the air conditioner 1 through the first discharging port 105 or the plurality of discharging holes 112. In the embodiment, the support frame 114 may be formed in a honeycomb structure as shown in FIG. 3. The support frame 114 is not, however, limited thereto, but may have various forms with cavities that do not block the first flow path S1.

Figure 6:
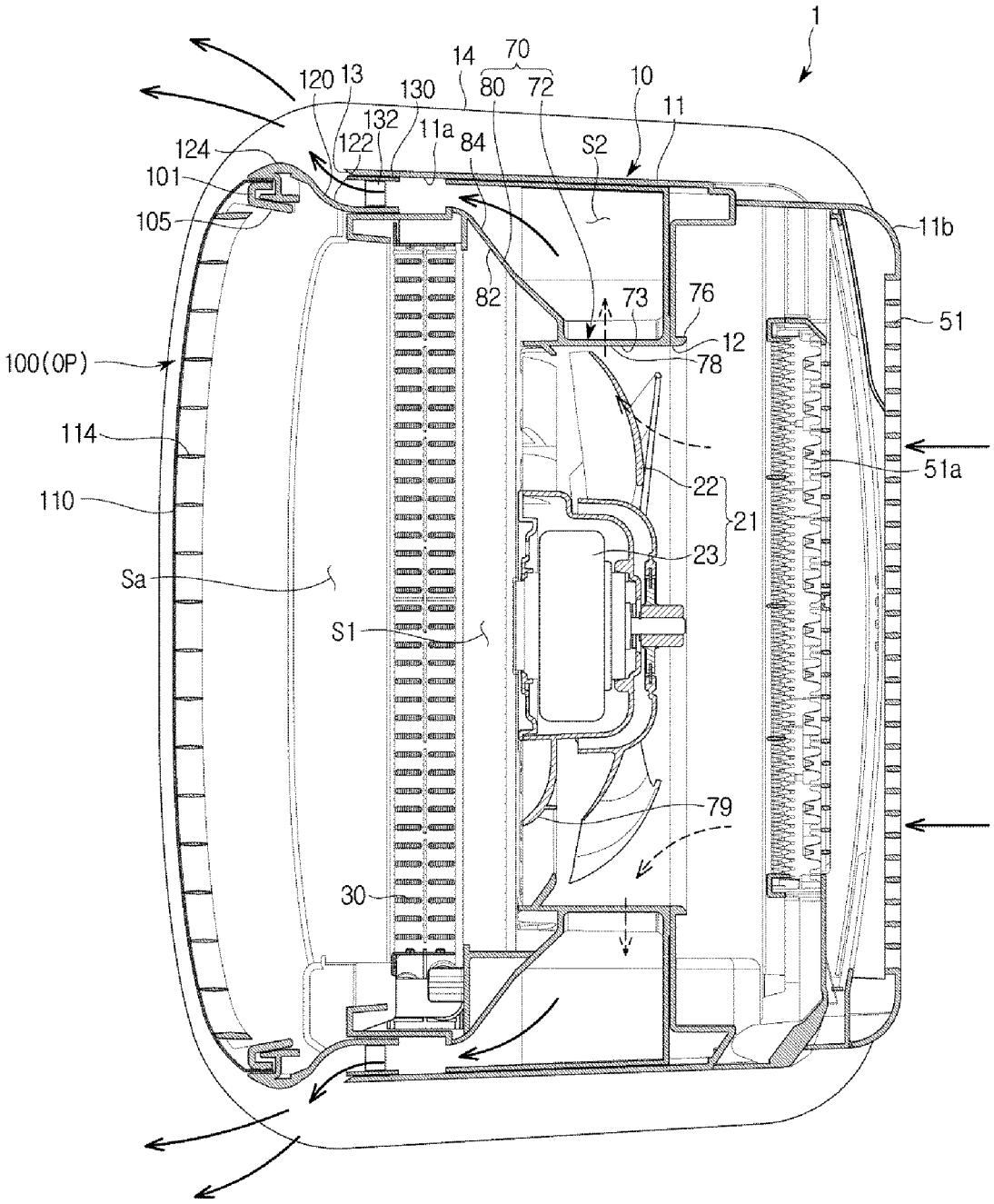
FIGS. 6 and 7 are cross-sectional views representing air flows of an air conditioner operating in a second mode, according to an embodiment of the present disclosure.

The air conditioner 1 may include a plurality of blades 132 to guide the air discharged through the second discharging port 13. The plurality of blades 132 may be arranged successively in the longitudinal direction of the second discharging port 13. In the embodiment, the plurality of blades 132 are arranged in the second flow path S2. However, alternatively, the blades 132 may be arranged in the second discharging port 13. The plurality of blades 132 may be rotationally arranged to move between a closing position to block the second flow path S2 as shown in FIG. 4 and an opening position to control a wind direction of the air flowing in the second flow path S2 as shown in FIG. 6.

The second discharging port 13 may be formed to be long in the vertical direction to correspond to the longitudinal direction of the discharging door 100, which corresponds to the vertical direction. That is, the cross-sectional area in the airflow direction may be formed to be long in the vertical direction. To correspond to the second discharging port 13, the second flow path S2 may also be formed to have a cross-sectional area which is long in the vertical direction. The plurality of blades 132 may be arranged in the longitudinal direction of the second discharging port 13 or the second flow path S2 at predetermined intervals.

The discharging door 100 may include an interval maintainer member 130 that keeps the second discharging port 13 to a constant size. The interval maintainer member 130 may be formed to keep the second discharging port 13 to less than predetermined width when the discharging door 100 moves from the closing position CP to the opening position OP. The interval maintainer member 130 may be arranged to be adjacent to the second discharging port 13. The interval maintainer member 130 may be moved along with the discharging door 100. For example, the interval maintainer member 130 may be provided to make parallel movement or turning movement along with the discharging door 100. In other words, the interval maintainer member 130 may be coupled with the discharging door 100 to be moved along with the discharging door 100. The interval maintainer member 130 may be provided to be in contact with the inner side 11*a* of the housing (see FIG. 2 or 6) and to slide on the housing 10.

Because the second discharging port 13 is arranged on either side of the discharging door 100 as a pair, there may also be a pair of interval maintainer members 130 arranged at the pair of the second discharging ports 13. When the discharging door 100 moves from the closing position CP to the opening position OP, the interval maintainer member 130 may also be moved to the opening position OP, maintain the second discharging port 13 to have constant width and area.

In a case that the discharging door 100 makes parallel movement from the closing position CP to the opening position OP, the pair of second discharging ports 13 may be formed between one of the interval maintainer member 130 and the housing 11 and the rear side of the panel connector 120. Specifically, of the space between the interval maintainer member 130 and the rear side of the panel connector 120 and the space between the housing 11 and the rear side of the panel connector 120, a smaller space may form the second discharging port 13.

This may be equally applied to a case where the discharging door 100 makes turning movement so that one side protrudes forward more than the other side does.

For example, when the discharging door 100 is separated from the housing 10 by less than a predetermined distance, the second discharging port 13 may be formed between the rear side of the panel connector 120 and the housing 10. Furthermore, when the discharging door 100 is separated from the housing 10 by the predetermined distance or more, the second discharging port 13 may be formed between the rear side of the panel connector 120 and the interval maintainer member 130.

With this structure and operation, the second discharging port 13 may be prevented from getting wider than a predetermined width. Moreover, even in the case that the discharging door 100 makes turning movement, unequal distribution of the air discharge volume due to the different cross-sectional areas of the second discharging ports 13 may be prevented.

Because the interval between the interval maintainer 130 and the panel connector 120 is constant, the area or width of the second discharging port 13 may be maintained to be less than a predetermined area or width even with the parallel movement or turning movement of the discharging door 100. For this, the interval maintainer member 130 may be formed as a part of the discharging door 100 to be moved or turned along with the movement of the discharging door 100. The interval maintainer member 130 is not, however, limited thereto. For example, the interval maintainer member 130 may be formed as a part of the main housing 11 to be moved against the main housing 11.

The air conditioner 1 may include a movement member 140 for movement of the discharging door 100. The movement member 140 is arranged on the rear side of the discharging door 100 to move the discharging door 100. The movement member 140 may be provided in the plural for the discharging door 100 to make parallel movement or turning movement. In the embodiment, when viewed from the front, the air conditioner 1 may have a pair of movement members 140 on the upper left and right sides and a pair of movement members 140 on the lower left and right sides. For the discharging door 100 to make parallel movement, these four movement members 140 may operate together. Different movements of the four movement members 140 are made for movement of at least one of the left side, right side, top side, and bottom side of the discharging door 100.

The movement member 140 may include a rack gear 142 and a pinion gear 144. The pinion gear 144 may be rotationally coupled to the main housing 11, and the rack gear 142 is engaged with the pinion gear 144 to convert the turning movement of the pinion gear 144 to linear movement. The rack gear 142 is coupled to the rear side of the discharging door 100 to receive the driving power of the pinion gear 144 and move the discharging door 100.

An air flow path linking the first suction port 12 and the first discharging port 105 is called the first flow path S1, and an air flow path linking the second suction port 15 and the second discharging port 13 is called the second flow path S2. The first and second flow paths S1 and S2 may be divided by the middle member 70. This may prevent mixture of the air flowing in the first flow path S1 and the air flowing in the second flow path S2.

The middle member 70 may be arranged on the inner side of the main housing 11. The middle member 70 may extend in a direction corresponding to the longitudinal direction of the main housing 11. In other words, the middle member 70 may extend in the vertical direction such that the vertical direction corresponds to the longitudinal direction.

The middle member 70 may include a guide part 72 and a divider part 80. The guide part 72 may cover a first blower fan 22 of a first blower unit 21, which will be described later, in the circumferential direction of the first blower fan 22 with a gap outward from the outer circumferential face of the first blower fan 22. The guide part 72 may guide the air brought in through the first suction port 12 to move into the first blower fan 22 and the air blown by the first blower fan 22 to the first discharging port 105.

The guide part 72 may include an opening 73, the inner side of which the first blower fan 22 is arranged on. In this embodiment, there are three first blower fans 22, and there may be three openings formed as well.

The guide part 72 may include a bell-mouth part 76 for guiding air to flow into the first blower fan 22, a diffuser part 78 for guiding air blown by the first blower fan 22 to the front, and a plurality of discharging blades 79.

The bell-mouth part 76 may be arranged on the rear side of the guide part 72 to guide the air brought in through the first suction port 12 to the first blower fan 22. The diffuser part 78 may be provided to extend forward from the bell-mouth part 76. The plurality of discharging blades 79 may extend from the inner circumferential face of the diffuser part 78 in the direction of the rotational shaft of the first blower fan 22. The diffuser part 78 may direct the air blown by the first blower fan 22 forward, and the plurality of discharging blades 79 may guide the discharged air current blown forward to flow in a particular direction.

The divider part 80 may separate the first and second flow paths S1 and S2 from each other. The divider part 80 is formed to extend from the guide part 72 toward the front. The divider part 80 may extend from the outer side of the guide part 72 to an inner portion 11*a* of the side of the main housing 11 to separate the first and second flow paths S1 and S2 from each other.

The divider part 80 may be provided to allow the air flowing in the first flow path S1 and the air flowing in the second flow path S2 to be discharged through the first discharging port 105 and the second discharging port 13, respectively, without being mixed. In other words, the divider part 80 may be formed without a section linking the first and second flow paths S1 and S2 by separating the first and second flow paths S1 and S2 from each other.

Accordingly, the air in the first flow path S1 may be discharged out of the housing 10 without being mixed with the air in the second flow path S2 inside the housing 10 while flowing from the first suction port 12 to the first discharging port 105. The air in the second flow path S2 may also be discharged without being mixed with the air in the first flow path S1 inside the housing 10.

Specifically, the divider part 80 may have the form of a plate with a curved part to separate the first and second flow paths S1 and S2 from each other. In other words, one side 121 of the divider part 80 may constitute some of the first flow path S1 and the other side 122 of the divider part 80 may constitute some of the second flow path S2.

At the lower end of the middle member 70, there may be an inflow part 130 opened in the vertical direction and linked with the second blower fan 26. The inflow part 130 may bring the air blown from the second blower fan 26 into the second flow path S2 and guide the air brought in through the second suction port 15 to the second flow path S2.

The air conditioner 1 may discharge the air that has exchanged heat with the heat exchanger 30 through the first discharging port 105 and discharge the air that has not passed the heat exchanger 30 through the second discharging port 13. In other words, the second discharging port 13 may be provided to discharge the not-heat-exchanged air. Because the heat exchanger 30 is arranged in the first flow path S1, the air discharged through the first discharging port 105 may be heat-exchanged air. Because the heat exchanger 30 is not arranged in the second flow path S2, the air discharged through the second discharging port 13 may be non-heat-exchanged air.

Alternatively, the air conditioner 1 may be implemented to discharge the heat-exchanged air through the second discharging port 13. That is, there may be a heat exchanger arranged in the second flow path S2 as well. Specifically, the heat exchanger for the air to be discharged through the second discharging port 13 to exchange heat may be arranged in an accommodating space 19 of the main housing 11. With this configuration, the air conditioner 1 may provide heat-exchanged air through both the first and second discharging ports 105 and 13. Although a heat exchanger may be arranged in the second flow path S2, the heat exchangers arranged in the first and second flow paths S1 and S2 may be distinguished from each other. For example, the air conditioner 1 may be implemented to prevent mixture of the air flowing in the first flow path S1 and the air flowing in the second flow path S2 while air-conditioning the room.

There may be a support stand 14 provided in the main housing 11. The support stand 14 may be arranged at the bottom of the main housing 11. The support stand 14 may stably support the housing 10 against the floor.

Inside the main housing 11, there may be the accommodating space 19 in which electronic parts (not shown) are arranged. The electronic parts arranged in the accommodating space 19 may be required to operate the air conditioner 1. A second blower unit 26 may be arranged in the accommodating space 19.

The blower unit 20 may include the first and second blower units 21 and 26. The second blower unit 26 may be provided to be driven separately from the first blower unit 21. The second blower unit 26 may have a different rotation speed from the rotational speed of the first blower unit 21.

The first blower unit 21 may be arranged in the first flow path S1 formed between the first suction port 12 and the first discharging port 105. The first blower unit 21 may bring the air into the housing 10 through the first suction port 12. The air brought in through the first suction port 12 may move along the first flow path S1 and may be discharged out of the housing 10 through the first discharging port 105. The first blower unit 21 may include the first blower fan 22 and a first fan driver 23.

The first blower fan 22 may be an axial-flow fan or a mixed-flow fan. However, the type of the first blower fan 22 is not limited thereto, and the first blower fan 22 may be any type of fan as long as the first blower fan 22 may circulate air such that the air that has been drawn in from the outside of the housing 10 is discharged back to the outside of the housing 10. For example, the first blower fan 22 may be a cross fan, a turbo fan, or a sirocco fan.

Although there are three first blower fans 22 illustrated in FIG. 2, the number of the first blower fans 22 is not limited thereto, but may vary as needed.

The first fan driver 23 may drive the first blower fan 22. The first fan driver 23 may be located in the center of the first blower fan 22. The first fan driver 23 may include a motor.

The second blower unit 26 may be arranged in the second flow path S2 formed between the second suction port 15 and the second discharging port 13. The second blower unit 26 may bring the air into the housing 10 through the second suction port 15. The air sucked in through the second suction port 15 may move along the second flow path S2 and may be discharged out of the housing 10 through the second discharging port 13.

The second blower unit 26 may include the second blower fan 27, a second fan driver 28, and a fan case 29.

The second blower fan 27 may employ a centrifugal fan. However, the type of the second blower fan 27 is not limited thereto, and the second blower fan 27 may be any type of fan as long as the second blower fan 27 may circulate air such that the air that has been drawn in from the outside of the housing 10 is discharged back to the outside of the housing 10. For example, the second blower fan 27 may be a cross fan, a turbo fan, or a sirocco fan.

The fan case 29 may cover the second blower fan 27. The fan case 29 may include a fan inflow port 29*a* through which air is brought in, and a fan outflow port 29*b* through which air is discharged. Where to locate the fan inflow port 29*a* and the fan outflow port 29*b* may be determined depending on the type of the second blower fan 27.

The heat exchanger 30 may be located between the first blower unit 21 and the first discharging port 105. The heat exchanger 30 may be arranged in the first flow path S1. The heat exchanger 30 may absorb heat from the air brought in through the first suction port 12 or transfer heat to the air brought in through the first suction port 12.

The first blower unit 21 may be located between the heat exchanger 30 and the first suction port 105. The air flowing in the first flow path S1 slows down while passing the plurality of discharging holes 112 and is discharged out of the air conditioner 1 at the reduced speed. The heat exchanger 30 may include a tube and a header coupled to the tube. This structure of the heat exchanger 30 may generate air resistance against the air flowing in the first flow path S1 to reduce the flow rate. Specifically, the first blower unit 21 is arranged on the rear side of the heat exchanger 30 such that the air flowing in the first flow path S1 slows down while passing the heat exchanger 30. With the arrangement of the heat exchanger 30 and the first blower unit 21, the performance of the plurality of discharging holes 112 formed on the discharging panel 110 may be maximized. However, the type of the heat exchanger 30 is not limited thereto.

The air conditioner 1 may have the discharging panel 110 arranged on some part of the door frame 101 on which the first discharging port 105 is formed. The discharging panel 110 may have the plurality of discharging holes 112 for the air discharged through the first discharging port 105 to be discharged at a lower speed than the air discharged through the second discharging port 13. The discharging panel 110 may be coupled to and supported by the door frame 101.

The plurality of discharging holes 112 may penetrate the inner and outer surfaces of the discharging panel 110. The plurality of discharging holes 112 may be formed in a fine size. The plurality of discharging holes 112 may be uniformly distributed in the entire area of the discharging panel 110. The plurality of discharging holes 112 may allow the heat-exchanged air to be uniformly discharged through the first discharging port 105 at low speed.

The housing 10 may have a rear housing 11*b* arranged behind the first suction port 12 of the main housing 11. However, the rear housing 11*b* may be formed with the main housing 11 in a single body. However, for convenience of assembling of the parts to be arranged inside the main housing 11, the main housing 11 and the rear housing 11*b* may be separately arranged and assembled together as in the embodiment of the present disclosure.

The rear housing 11*b* may include a first suction grill 51 formed on the rear side of the rear housing 11*b*. The first suction grill 51 may be provided to prevent foreign materials from being brought in through the first suction port 12. For this, the first suction grill 51 may include a plurality of slits or holes. The first suction grill 51 may be formed to cover the first suction port 12.

The air conditioner 1 may include a second suction grill 52 coupled to a portion of the main housing 11, at which the second suction port 15 is formed. The second suction grill 52 may be provided to prevent foreign materials from being brought in through the second suction port 15. For this, the second suction grill 52 may include a plurality of slits or holes. The second suction grill 52 may be formed to cover the second suction port 15.

A first filter 51*a* may be arranged between the first suction grill 51 and the first suction port 12, and a second filter 52*a* may be arranged between the second suction grill 52 and the second suction port 15. The first and second filters 51*a* and 52*a* may be additionally provided to prevent foreign materials that may not be filtered out by the suction grills 51 and 52 from being brought in.

Each of the first and second filters 51*a* and 52*a* may be detachably inserted to the main housing 11.

In a case of a traditional air conditioner having two or more flow paths inside its housing, extra components to form the respective flow paths are arranged inside the housing 10. This increases internal space of the housing 10, leading to an increase in volume of the air conditioner, and increases material cost while decreasing assembling performance due to the increase in the components. Furthermore, as the flow paths are formed by the extra components, there are persistent impacts on the assembly of the additional components due to airflows in the flow paths, causing vibrations or noise.

On the contrary, in the air conditioner according to an embodiment of the present disclosure, both the first and second flow paths S1 and S2 are formed by the middle member 70, i.e., the plurality of flow paths S1 and S2 may be formed inside the housing 10 without extra components.

Specifically, the first flow path S1 may be formed by the one side 121 of the guide part 72 and divider part 80 of the middle member 70 and at least some of the inside of the main housing 11, and the second flow path S2 may be formed by the other side 122 of the divider part 80 of the middle member 70 and the inner portion 11*a* of the side of the main housing 11. That is, the flow paths S1 and S2 may be formed substantially by the middle member 70 and the main housing 11 without extra components.

The plurality of flow paths may be formed with a single component in that the first and second flow paths S1 and S2 are separately formed by the divider part 80 that extends from the outer side of the guide part 72. While the traditional air conditioner includes the extra components to form an auxiliary flow path, which may serve as the second flow path S2, in addition to a cylindrical molded object including the bell-mouth and diffuser part 78 that forms the main flow path, the air conditioner 1 in accordance with the embodiment of the present disclosure may have two flow paths S1 and S2 formed without extra components as the divider part 80 to form the second flow path S2 is integrally formed with the guide part 72 corresponding to the bell-mouth and diffuser part 78.

Accordingly, the air conditioner 1 in accordance with the embodiment of the present disclosure may have more compact volume and have reduced vibrations or noise caused by the air flowing in the flow paths as compared to the traditional air conditioner having a plurality of flow paths, because there are no extra components arranged inside the housing 10 of the air conditioner 1.

Figure 5:
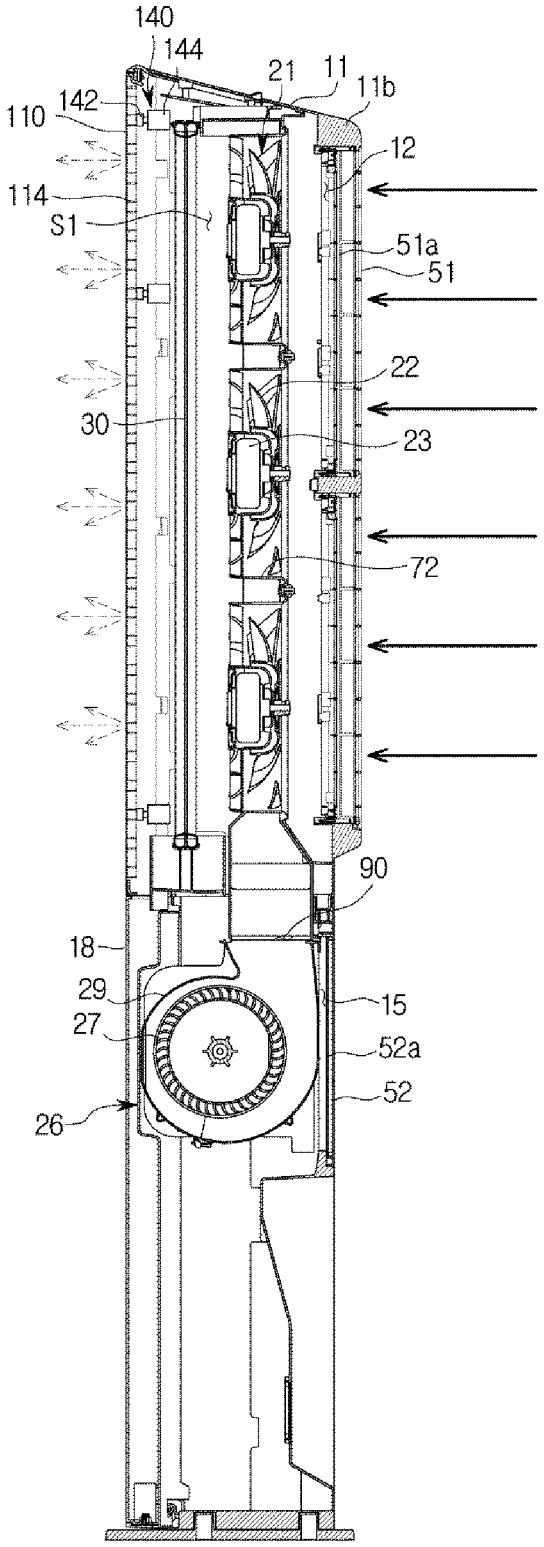
Figure 7:
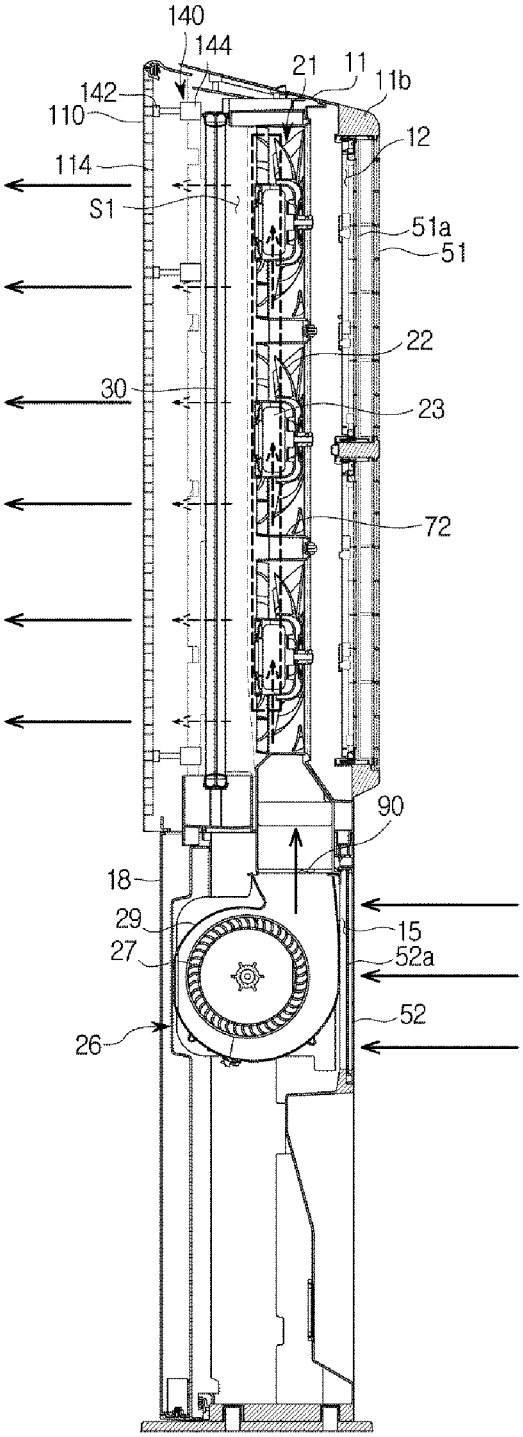
Figure 8:
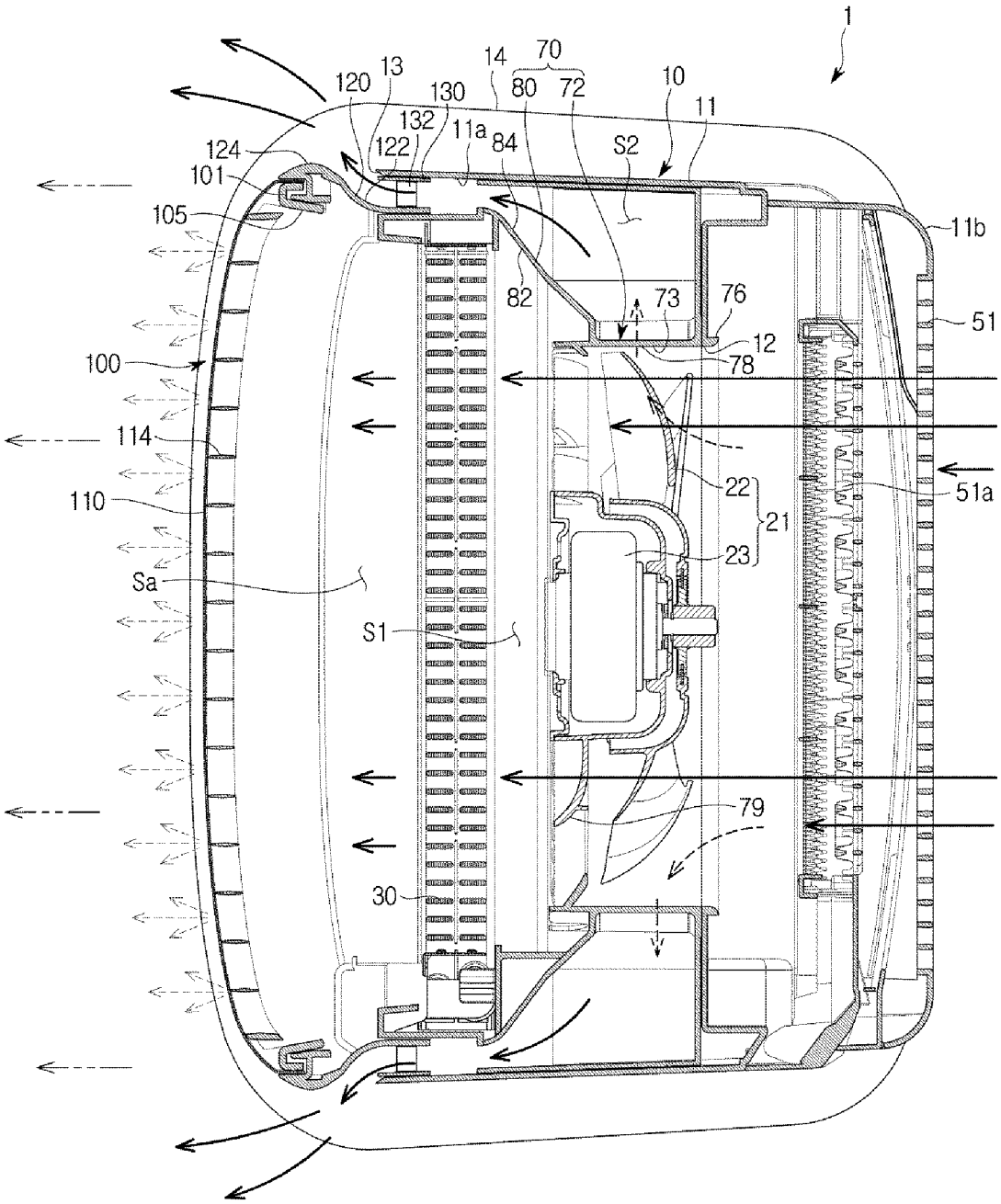
FIGS. 8 and 9 are cross-sectional views representing air flows of an air conditioner operating in a third mode, according to an embodiment of the present disclosure.
Figure 9:
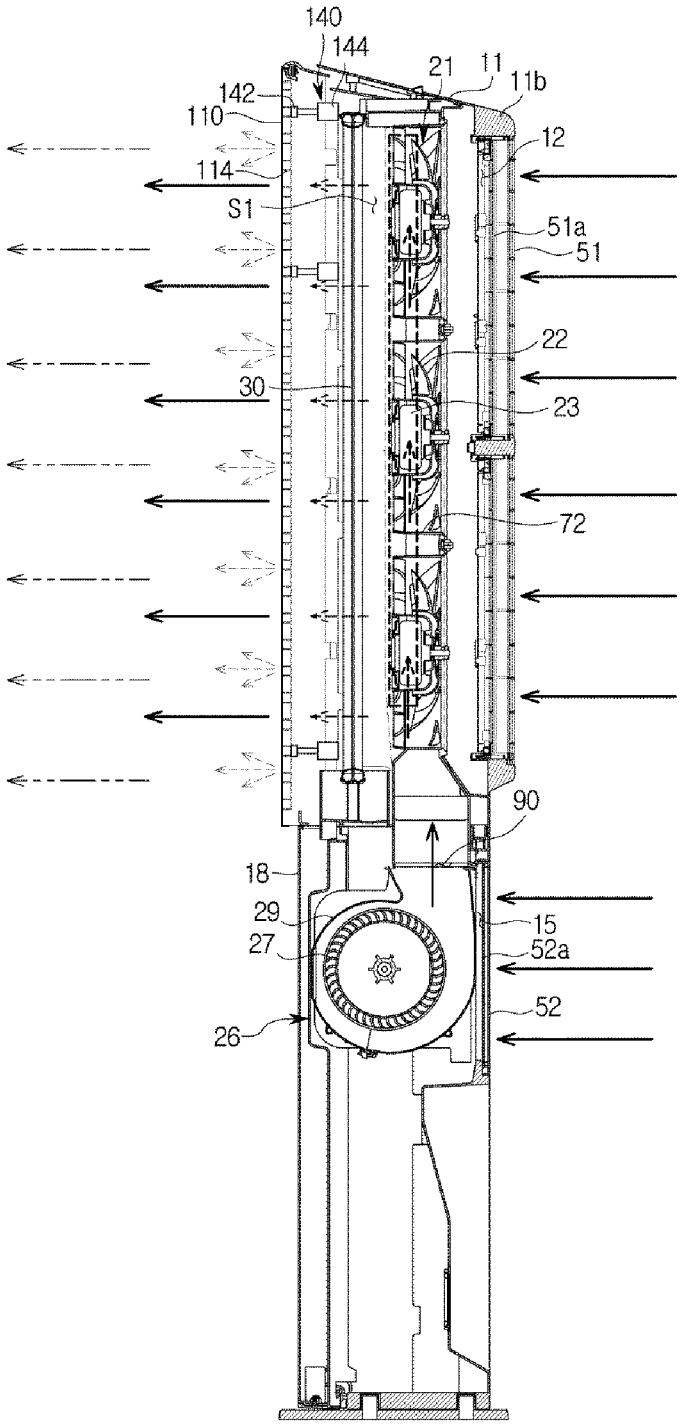

FIGS. 4 and 5 are cross-sectional views representing air flows of an air conditioner operating in a first mode, according to an embodiment of the present disclosure, FIGS. 6 and 7 are cross-sectional views representing air flows of an air conditioner operating in a second mode, according to an embodiment of the present disclosure, and FIGS. 8 and 9 are cross-sectional views representing air flows of an air conditioner operating in a third mode, according to an embodiment of the present disclosure.

Operation of an air conditioner will now be described in connection with FIGS. 4 to 9.

Referring first to FIGS. 4 and 5, the air conditioner 1 may be operated in a first mode in which the heat-exchanged air is discharged only though the first discharging port 105. Because the discharging panel 110 is arranged in the first discharging port 105, air conditioning is gradually performed all around in the room. Specifically, when the air is to be discharged out of the housing 10 through the first discharging port 105, air may pass the plurality of discharging holes 112, which may reduce the speed of the air, and may then be discharged at the low speed. With this configuration, the air conditioner 1 may cool or heat the room at a wind speed that makes the user feel pleasant.

Specifically, as the first blower unit 21 is operated, the air outside the housing 10 may be brought into the housing 10 through the first suction port 12. The air brought into the housing 10 may exchange heat while passing the heat exchanger 30 past the first blower unit 21. The air that has exchanged heat while passing the heat exchanger 30 may be discharged out of the housing 10 through the first discharging port 105 at a reduced speed after passing through the discharging panel 110. That is, the heat-exchanged air flowing in the first flow path 51 may be discharged at a wind speed that may give pleasant feeling to the user.

Because the second blower unit 26 is not operated in the first mode, no air is discharged through the second discharging port 13.

Referring to FIGS. 6 and 7, the air conditioner 1 may be operated in a second mode in which the non-heat-exchanged air is discharged only though the second discharging port 13. Because there is no heat exchanger located in the second flow path S2, the air conditioner 1 may circulate the room air.

To operate the air conditioner 1 in the second mode, the discharging door 100 moves from the closing position CP to the opening position OP where the second discharging port 13 is opened. With the curved guide part 13*a* arranged in front of the second discharging port 13, the air discharged through the second discharging port 13 may be discharged forward from the air conditioner 1. With the discharging blade 132 arranged in the second flow path S2, the air to be discharged through the second discharging port 13 may be uniformly discharged in the longitudinal direction of the second discharging port 13.

Specifically, as the second blower unit 26 is operated, the air outside the housing 10 may be brought into the housing 10 through the second suction port 15. The air brought into the housing 10 may pass the second blower unit 26, and may then flow into the second flow paths S2 formed on both sides of the first flow path 51 through the inflow part 130 of the middle member 70, which is opened in the vertical direction. The air may move upward in the second flow path S2, and may then be discharged out of the housing 10 through the second discharging port 13. At this time, the air may be guided to the front of the air conditioner 1 along the curved guide part 13*a*.

Because the first blower unit 21 is not operated in the second mode, no air is discharged through the first discharging port 105. In the second mode, the air conditioner 1 blows the no-heat-exchanged air to simply perform circulation of the room air or to provide strong wind for the user.

Referring to FIGS. 8 and 9, the air conditioner 1 may be operated in a third mode in which the heat-exchanged air is discharged though the first and second discharging ports 105 and 13. To operate the air conditioner 1 in the third mode, the discharging door 100 moves from the closing position CP to the opening position OP where the second discharging port 13 is opened. The air conditioner 1 may discharge cold air further away when operated in the third mode than in the first mode.

Specifically, when the air conditioner 1 is operated in the third mode, the cold air discharged through the first discharging port 105 and the cold air discharged through the second discharging port 13 may be mixed. Because the air discharged through the second discharging port 13 has a faster speed than the air discharged through the first discharging port 105, the air discharged through the second discharging port 13 may move the cold air discharged through the first discharging port 105 further away.

With this configuration, the air conditioner 1 may provide pleasant cool air, a mixture of the cold air and the room air for the user.

Furthermore, the air conditioner 1 may be configured to provide cold air to different distances by changing driving power of the first and/or second blower unit 21 and/or 26. Specifically, the first blower unit 21 may be configured to control a volume and/or speed of the air discharged through the first discharging port 105, and the second blower unit 26 may be configured to control a volume and/or speed of the air discharged through the second discharging port 13.

For example, when the volume and/or speed of the air discharged through the second discharging port 13 is increased by increasing the driving power for the second blower unit 26, the air conditioner 1 may move the cold air further away. On the contrary, when the volume and/or speed of the air discharged through the second discharging port 13 is reduced by reducing the driving power for the second blower unit 26, the air conditioner 1 may move the cold air to a relatively near range.

Figure 10:
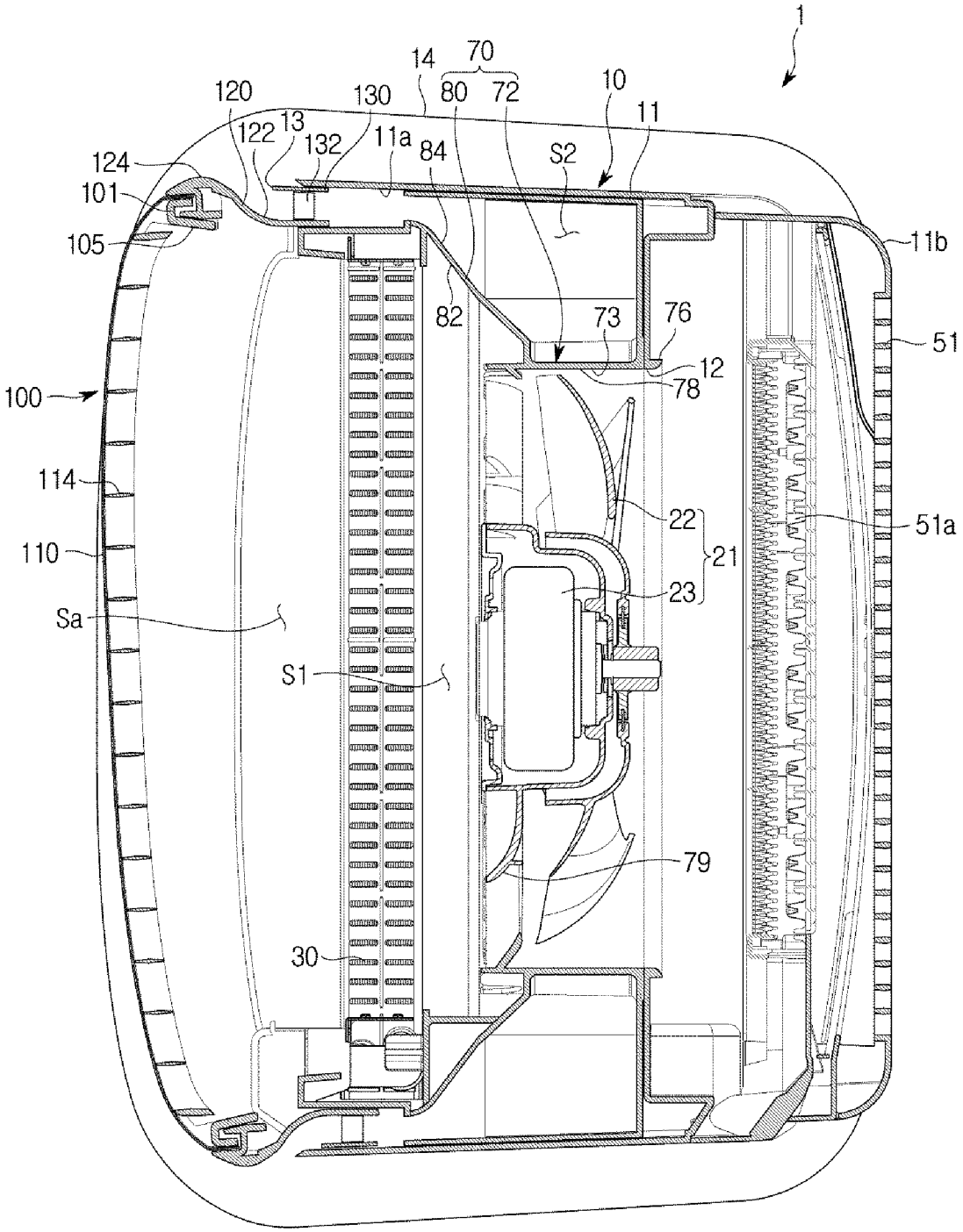
FIGS. 10 and 11 show left and right turning operations of an air conditioner, according to an embodiment of the present disclosure.
Figure 11:
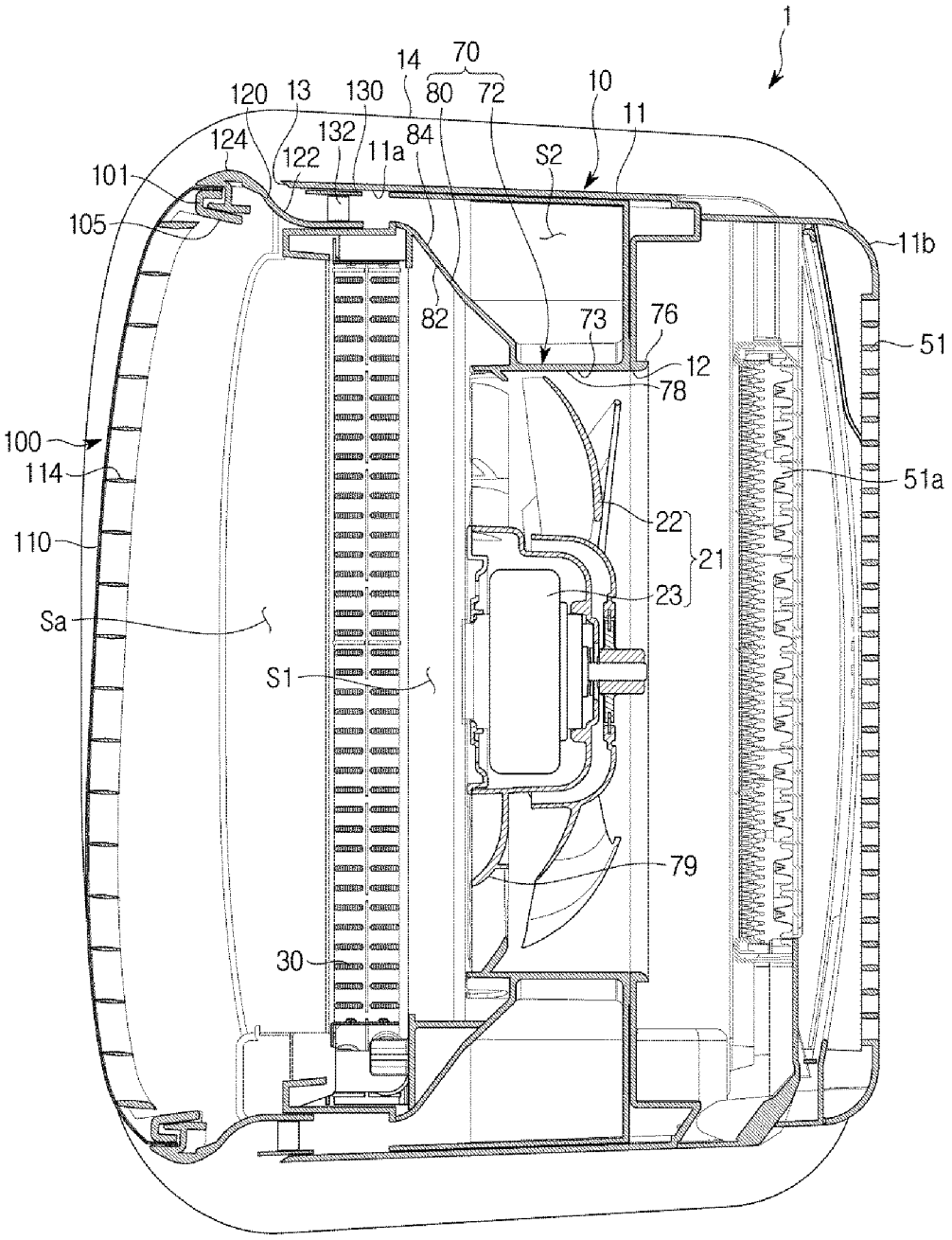

FIGS. 10 and 11 show left and right turning operations of an air conditioner, according to an embodiment of the present disclosure.

Referring first to FIG. 10, when viewed from the front, the air conditioner 1 is operated such that the left side of the discharging door 100 protrudes forward from the air conditioner 1 further than the right side of the discharging door 100 does. With the operation, the second discharging port 13 on the left may have wider width than the second discharging port 13 on the right does. The air conditioner 1 may also be operated such that the second discharging port 13 on the left is opened while the second discharging port 13 on the right is closed, by controlling an extent of movement of the discharging door 100.

The interval maintainer member 130 is formed to maintain the width of the second discharging port 13 on the right to prevent an increase of the width of the second discharging port 13 on the right.

On the contrary, referring to FIG. 11, when viewed from the front, the air conditioner 1 is operated such that the right side of the discharging door 100 protrudes forward from the air conditioner 1 further than the left side of the discharging door 100 does. With the operation, the second discharging port 13 on the right may have wider width than the second discharging port 13 on the left does. The air conditioner 1 may also be operated such that the second discharging port 13 on the right is opened while the second discharging port 13 on the left is closed, by controlling an extent of movement of the discharging door 100.

The interval maintainer member 130 is formed to maintain the width of the second discharging port 13 on the left to prevent an increase of the width of the second discharging port 13 on the left.

Figure 12:
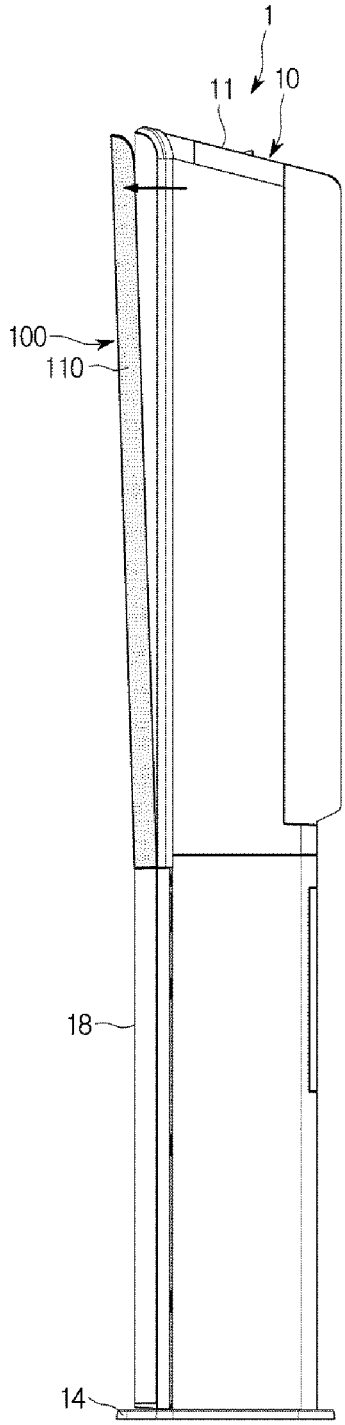
FIGS. 12 and 13 show up and down turning operations of an air conditioner, according to an embodiment of the present disclosure.
Figure 13:
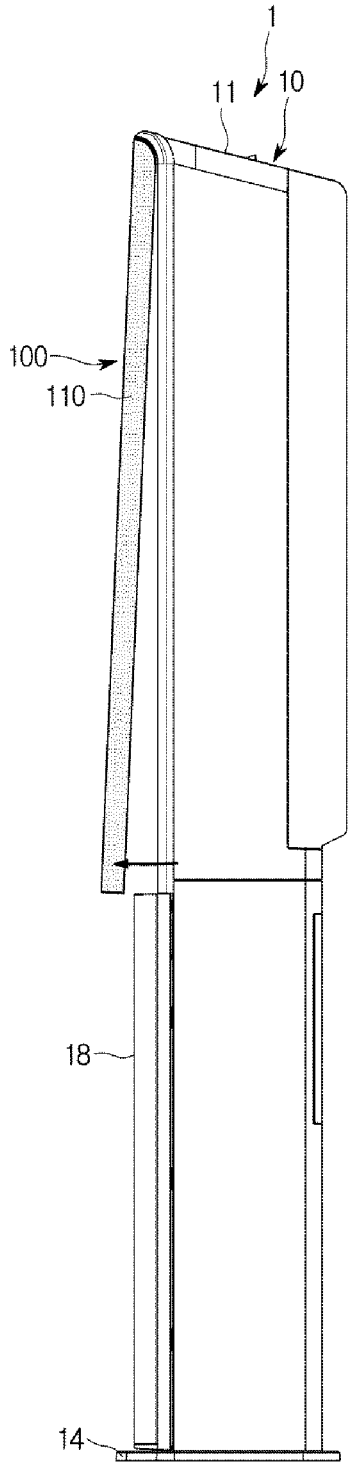

FIGS. 12 and 13 show up and down turning operations of an air conditioner, according to an embodiment of the present disclosure.

Referring to FIG. 12, when viewed from a side, the air conditioner 1 may be operated such that the upper portion of the discharging door 100 protrudes forward further than the lower portion does. With the operation, the second discharging ports 13 may be operated such that the upper one of them is opened wider than the lower one.

On the contrary, referring to FIG. 13, when viewed from a side, the air conditioner 1 may be operated such that the lower portion of the discharging door 100 protrudes forward further than the upper portion does. With the operation, the second discharging ports 13 may be operated such that the lower one of them is opened wider than the upper one.

As shown in FIGS. 10 to 13, the discharging door 100 may be operated such that at least some of the second discharging port 13 is opened as one of the top, bottom, left, and right sides of the discharging door 100 is separated from the main housing 11.

An air conditioner in accordance with an embodiment of the present disclosure will now be described. Description of features overlapping with what are described above will not be repeated.

Figure 14:
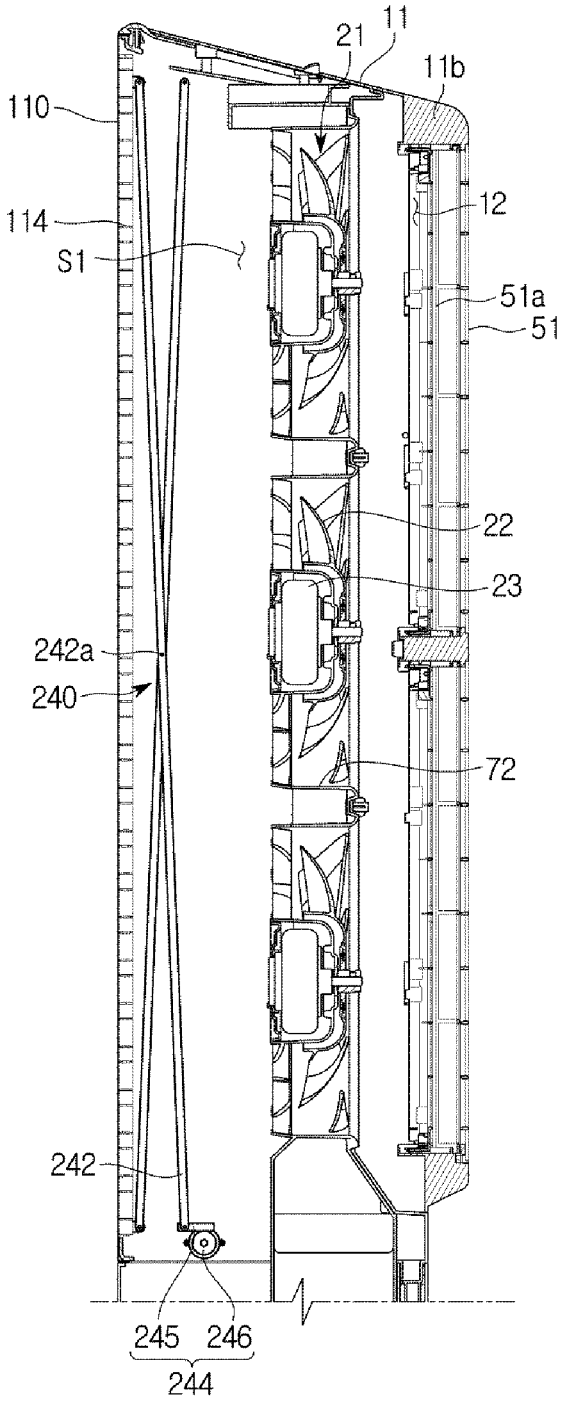
FIGS. 14 and 15 show operation of an air conditioner, according to an embodiment of the present disclosure.
Figure 15:
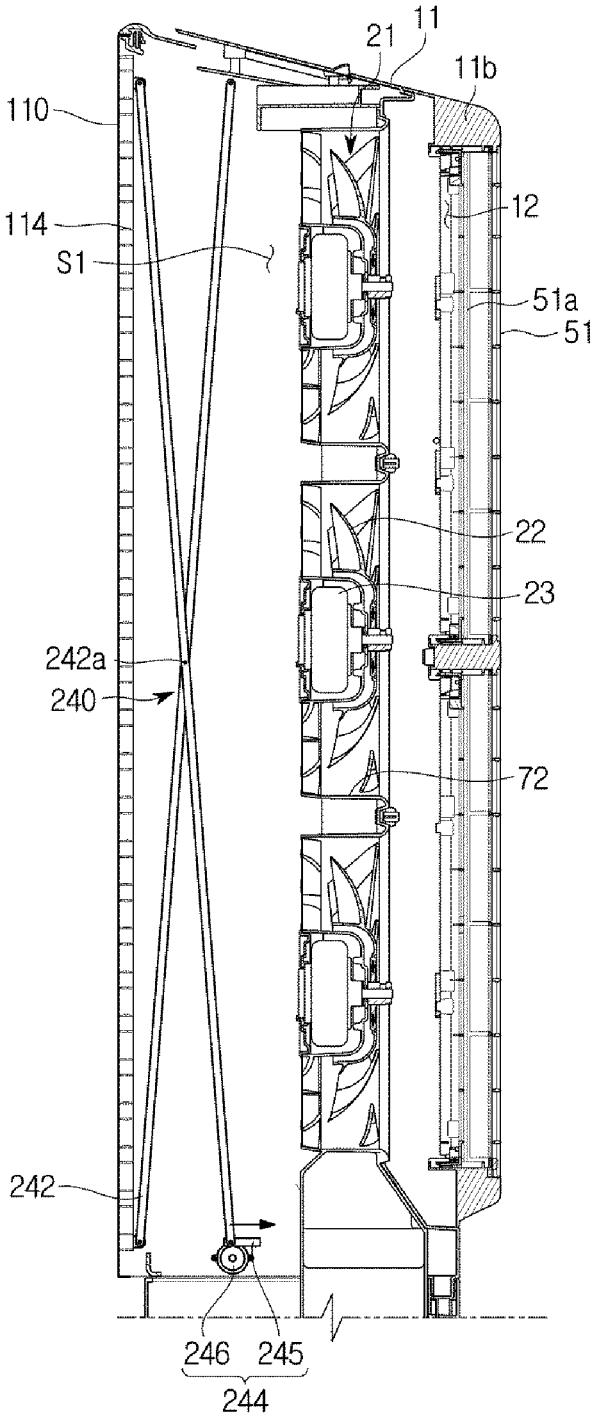

FIGS. 14 and 15 show operation of an air conditioner, according to an embodiment of the present disclosure.

The air conditioner 1 may include a movement member 240 for movement of the discharging door 100. The movement member 240 is arranged on the rear side of the discharging door 100 to move the discharging door 100.

The movement member 240 may include a link member 242 and a link driver member 244. The link member 242 may be provided to be able to rotate around a rotational shaft 242*a* against the housing 10. One end of the link member 242 may be rotationally coupled to the rear side of the discharging door 100 and the other end may be rotationally coupled to the link driver member 244.

The link driver member 244 may be provided to be movable along the front-and-back direction of the housing 11. The link driver member 244 may include a rack gear 245 and a pinion gear 246. The pinion gear 246 is installed to be able to rotate inside the housing 11 to transfer driving power to the rack gear 245. The rack gear 245 is configured to be movable in the front-and-back direction with the rotational force of the pinion gear 246. The rack gear 245 is rotationally coupled to the link member 242 at one end to transfer an amount of movement in the front-and-back direction of the rack gear 245 to the link member 242.

The link member 242 may move the discharging door 100 in the front-and-back direction by transferring the driving power transferred from the rack gear 145 at one end to the discharging panel 110 of the discharging door 100 coupled to the other end of the link member 242. The other end of link member 242 may be arranged to be movable on the rear side of the discharging door 100 in the vertical direction in order for the discharging door 100 to be movable only in the front-and-back direction.

There may be a plurality of link members 242 formed inside the housing 10. In this embodiment, there are a pair of link members 242 and a pair of link driver members 244 to support upper and lower sides of the discharging door 100, without being limited thereto. For example, there may be one or more link members 242 and corresponding link driver members 244 to support left and right sides of the discharging door 100.

An air conditioner in accordance with an embodiment of the present disclosure will now be described. Description of features overlapping with what are described above will not be repeated.

Figure 16:
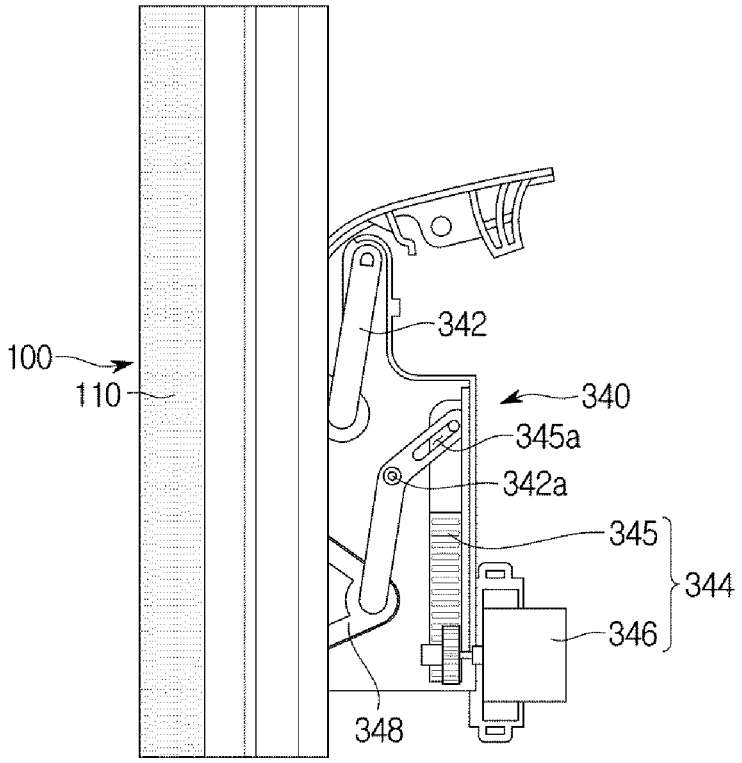
FIGS. 16 and 17 show operation of an air conditioner, according to an embodiment of the present disclosure.
Figure 17:
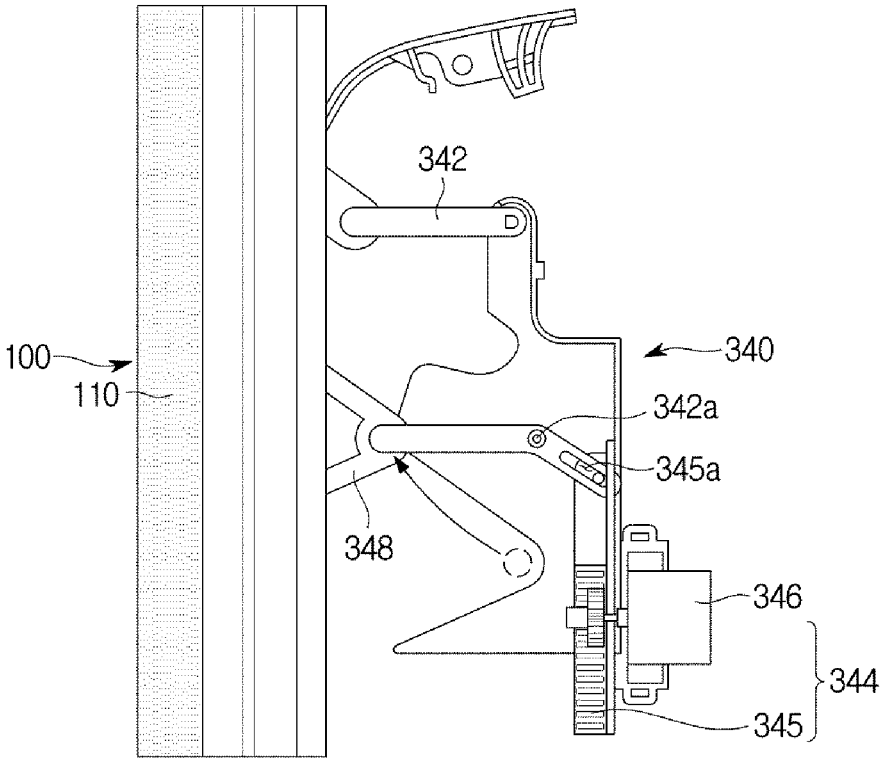

FIGS. 16 and 17 show operation of an air conditioner, according to an embodiment of the present disclosure.

The air conditioner 1 may include a movement member 340 for movement of the discharging door 100. The movement member 340 is arranged on the rear side of the discharging door 100 to move the discharging door 100.

The movement member 340 may include a link member 342, and a link driver member 344 to operate the link member 342. One end of the link member 342 may be rotationally coupled to the rear side of the discharging door 100 and the other end may be rotationally coupled to the link driver member 344. The link member 342 may be provided to be able to rotate around a rotational shaft 342*a* in the housing 10. The discharging door 100 may include a link installment member 348 on the rear side, which protrudes to be rotationally coupled to the one end of the link member 342.

The link driver member 344 may include a rack gear 345 and a pinion gear 346. The rack gear 345 may be coupled to the other end of the link member 342, and the pinion gear 346 may be rotationally installed against the housing 10. With the rotation of the pinion door 346, the rack gear 345 may be moved to move the discharging door 100. At a portion lying from the rotational shaft 342*a* of the link member 342 to the link driver member 344, there may be a cavity 345*a* formed for the rack gear 345 to be movable in the cavity 345*a*. With the configuration, the linear movement of the rack gear 345 may be converted to turning movement of the link member 342.

The link driver member 344 may move the discharging door 100 coupled to the one end of the link member 342 to the forward direction by moving the other end of the link member 342 in the vertical direction. In the embodiment, as the link driver member 344 operates, a portion lying from the rotational shaft 342*a* of the link member 342 to the link installment member 348 makes turning movement. The link member 342 is rotationally coupled to the link installment member 348, and as a result, the discharging door 100 makes the front-and-back movement as well as the vertical movement. The link driver member 344 is not, however, limited thereto. For example, the portion lying from the rotational shaft 342*a* of the link member 342 to the link installment member 348 may also have a cavity for the link installment member 348 to be moved therein, thereby allowing the discharging door 100 to be moved only in the front-and-back direction.

An air conditioner in accordance with an embodiment of the present disclosure will now be described. Description of features overlapping with what are described above will not be repeated.

Figure 18:
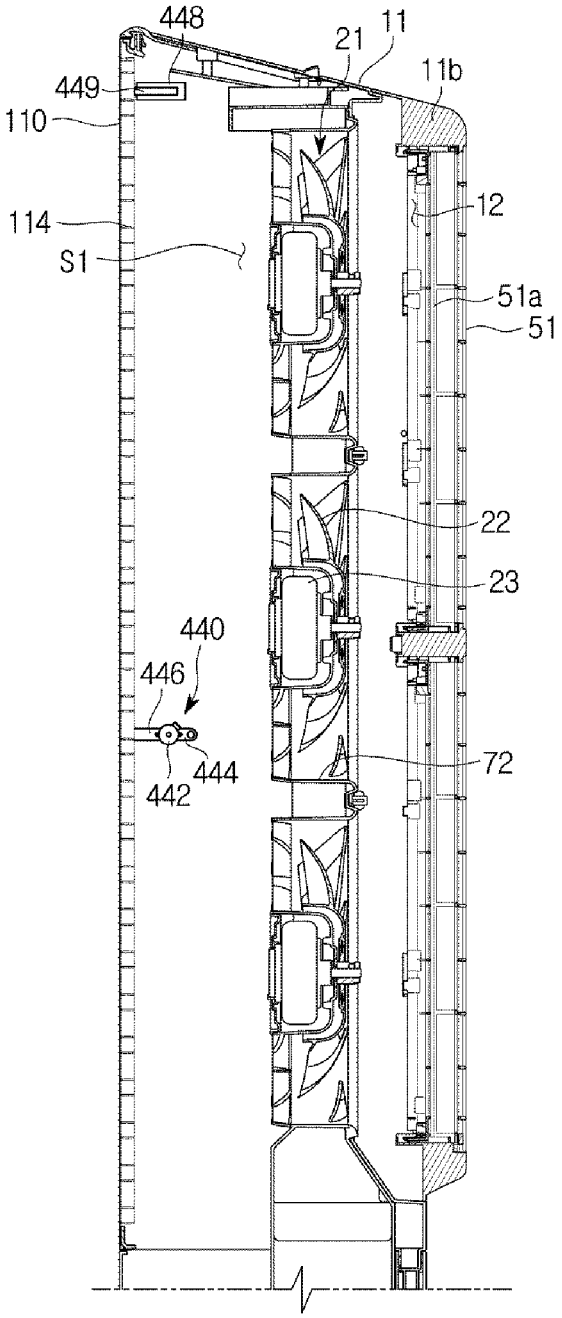
FIGS. 18 and 19 show operation of an air conditioner, according to an embodiment of the present disclosure.
Figure 19:
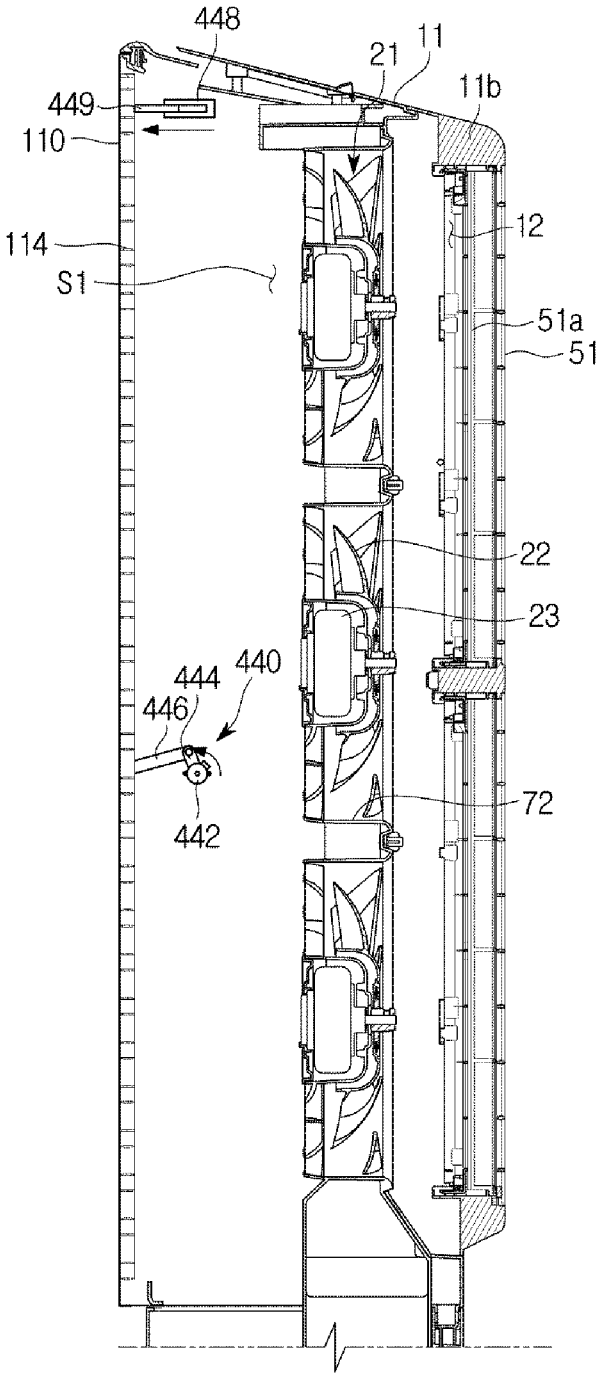

FIGS. 18 and 19 show operation of an air conditioner, according to an embodiment of the present disclosure.

The air conditioner 1 may include a movement member 440 for movement of the discharging door 100. The movement member 440 is arranged on the rear side of the discharging door 100 to move the discharging door 100.

The movement member 440 may have a crank structure. The movement member 440 may include a crankshaft 442, an eccentric member 444 that rotates around the crankshaft 442, and a power transfer member 446 rotationally coupled to the eccentric member 444.

The power transfer member 446 may be rotationally coupled at one end to the eccentric member 444 to be separated from the crankshaft 442 and rotationally coupled at the other end to the rear side of the discharging door 100. Rotation around the crankshaft 442 is transferred to rotate the eccentric member 444, and the rotation of the eccentric member 444 may move the power transfer member 446 and thus the discharging door 100 in the front-and-back direction. The movement member 440 may be provided in the plural for the discharging door 100 to make parallel movement or turning movement.

The movement member 440 may include a movement guide 449 to stably guide the movement of the discharging door 100. The movement guide 449 may be arranged on the rear side of the discharging door 100 and moved along a fixed frame 448 fixed on the housing 10. The movement member 440 is not, however, limited thereto. For example, the movement guide 449 may be fixed on the housing 10 and the fixed frame may be formed on the rear side of the discharging door 100. In this case, the fixed frame 448 may be moved along the movement guide 449 as the discharging door 10 moves.

An air conditioner in accordance with an embodiment of the present disclosure will now be described. Description of features overlapping with what are described above will not be repeated.

Figure 20:
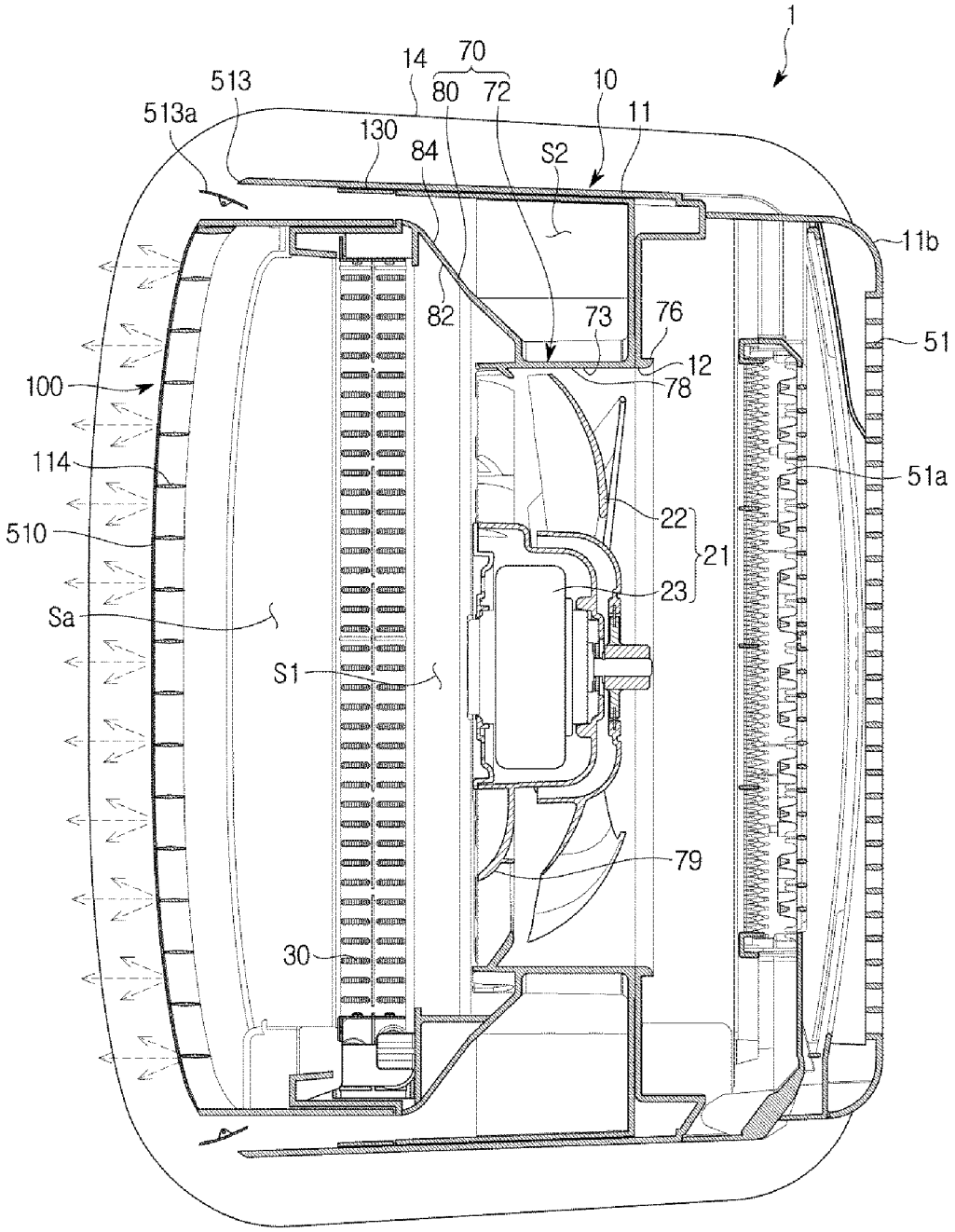
FIG. 20 is a cross-sectional view of an air conditioner, according to an embodiment of the present disclosure.

FIG. 20 is a cross-sectional view of an air conditioner, according to an embodiment of the present disclosure.

The air conditioner 1 may include a discharging panel 510 and a panel connector 520. The panel connector 520 may be formed to support the discharging panel 510. The panel connector 520 may be fixedly arranged relative to the middle member 70. The panel connector 520 is not, however, limited thereto, and as shown in FIGS. 6 and 8, the panel connector 520 may be provided to make relative movement to the middle member 70. In this case, the second flow path S2 may extend in length due to the panel connector 520.

The air conditioner 1 may include a second discharging port 513. The second discharging port 513 may be formed on the discharging panel 510. The second discharging port 513 may be arranged on the discharging panel 510 or may be separated from the discharging panel 510 and arranged to both sides of the discharging panel 510. For example, the plurality of discharging holes 112 may be arranged on the discharging panel 510 and the second discharging port 513 may be arranged to the side of the front of the discharging panel 510. Although the second discharging ports 513 are arranged to the left and right sides of the front in this embodiment, the second discharging ports 513 may be arranged to only one of the left and right sides.

The second discharging port 513 may include a discharging door 513*a*. The discharging door 513*a* may control discharging of the air flowing in the second flow path S2 by opening or closing the second discharging port 513. Furthermore, the discharging door 513*a* may control a wind direction of the air discharged from the second discharging port 513 by turning movement in the second discharging port 513.

According to embodiments of the present disclosure, an air conditioner is capable of having different air discharging methods by using a first discharging port with a discharging panel having a plurality of discharging holes arranged therein and a second discharging port for normal air blast.

The air conditioner may heat or cool a room at a minimum wind speed at which the user may feel pleasant by using the first discharging port with the discharging panel having the plurality of discharging holes arranged therein.

The air conditioner may provide wind that has not exchanged heat by discharging air through a second flow path with no heat exchanger arranged therein.

The air conditioner may provide a mixture of heat-exchanged air and room air by using a curved guide part that guides air discharged from the second discharging port to be mixed with the air discharged from the first discharging port.

The air conditioner may have the main body in a more compact size by effectively arranging the first and second flow paths in which heat-exchanged air flows.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

What is claimed is:

1. An air conditioner comprising:

a housing having a first suction port and a second suction port;

a heat exchanger configured to exchange heat with air drawn into the housing through the first suction port;

a first discharging port configured to discharge the heat-exchanged air from the housing;

a second discharging port configured to discharge air drawn into the housing through the second suction port in a direction to be mixed outside of the housing with the heat-exchanged air discharged from the first discharging port;

a discharging door having a plurality of discharging holes, through which the heat-exchanged air discharged by the first discharging port is discharged out of the housing, and configured to selectively open and close the second discharging port by a movement of the discharging door, wherein a discharge area of the first discharging port remains a constant size during the movement of the discharging door to selectively open and close the second discharging port.

2. The air conditioner of claim 1, wherein the discharging door is configured to move between a closing position to close the second discharging port, and an opening position to open the second discharging port.

3. The air conditioner of claim 2, wherein the movement comprises at least one of linear movement and rotational movement.

4. The air conditioner of claim 3, further comprising:

an interval maintainer configured to maintain the second discharging port at a predetermined width during the movement of the discharging door.

5. The air conditioner of claim 4, wherein the interval maintainer is arranged on an inner side of the housing and configured to be moved with the discharging door.

6. The air conditioner of claim 4, wherein the second discharging port is formed between the housing and a part of the interval maintainer proximate to a rear side of the discharging door.

7. The air conditioner of claim 2, wherein the discharging door opens at least some of the second discharging port at the opening position as at least one of top, bottom, left, and right sides of the discharging door is separated from the housing.

8. The air conditioner of claim 7, further comprising:

a movement gear coupled to the discharging door to move the discharging door, wherein the movement gear comprises a pinion gear rotationally coupled to the housing; and a rack gear coupled to a rear side of the discharging door to move the discharging door, the rack gear configured to convert a rotational movement of the pinion gear to linear movement of the rack gear and the discharging door.

9. The air conditioner of claim 2, wherein the discharging door comprises a discharging panel having the plurality of discharging holes formed therein; and a panel connector extending from the discharging panel and configured to be movable relative to the housing.

10. The air conditioner of claim 9, wherein the plurality of discharging holes are formed to discharge air out of the housing at a lower speed than a flow speed of the air in the first flow path, and wherein the discharging panel constitutes a front of the air conditioner and the plurality of discharging holes are uniformly distributed in the discharging panel.

11. The air conditioner of claim 9, further comprising:

a first air flow path in which air drawn into the housing through the first suction port passes the heat exchanger and flows toward the first discharging port;

a second air flow path in which air drawn into the housing through the second suction port flows to the second discharging port, the second air flow path separated from the first air flow path; and a middle divider fixedly arranged inside the housing and located between the first air flow path and the second air flow path, wherein the panel connector separates first air flow path and the second air flow path at the opening and closing positions together with the middle divider.

12. The air conditioner of claim 11, further comprising:

a first blower and a second blower arranged in the first air flow path and the second air flow path, respectively, to draw in external air from the first suction port and the second suction port, respectively, and transfer the air to the first discharging port and the second discharging port, respectively.

13. The air conditioner of claim 11, wherein the panel connector is configured to move relative to the middle divider while remaining in contact with the middle divider.

14. The air conditioner of claim 1, wherein the second discharging port is formed between a rear side of the discharging door and the housing.

15. The air conditioner of claim 14, wherein the discharging door comprises a curved guide formed on the rear side of the discharging door to guide air directed to the second discharging port.

16. The air conditioner of claim 15, wherein the discharging door comprises a curved edge formed for air flowing along the curved guide to be directed to a front of the discharging door, the curved edge coupled to the curved guide and protruding outward from an edge of the discharging door.

17. The air conditioner of claim 1, wherein the second discharging port is arranged to be adjacent to a side of the discharging door and parallel to the side, and wherein the second discharging port further includes a plurality of blades configured to guide air discharged from the second discharging port.

18. An air conditioner comprising:

a housing having a first air flow path and a second air flow path separated from the first air flow path;

a heat exchanger arranged in the housing and configured to exchange heat with air flowing in the first flow path; and a discharging door movably arranged on a front of the housing, wherein the discharging door comprises a discharging panel having a plurality of discharging holes formed to discharge the heat-exchanged air from the air conditioner at a lower speed than a flow speed of the heat-exchanged air in the first flow path, and constituting a front of the discharging door; and a panel connector extending toward the housing from the discharging panel and forming, together with the housing, a discharging port through which air flowing in the second flow path is discharged from the air conditioner, wherein a discharge area of the discharging panel remains a constant size during a movement of the discharging door.

19. The air conditioner of claim 18, wherein the discharging door is configured to move between a closing position to close the discharging port, and an opening position to open the discharging port, and wherein the housing comprises an interval maintainer configured to maintain the discharging port at a predetermined width during the movement of the discharging door from the closing position to the opening position.

20. An air conditioner comprising:

a housing having a first suction port and a second suction port;

a heat exchanger arranged in the housing;

a first blower;

a first discharging port coupled to the first suction port by a first air flow path and configured to discharge air from the housing that has exchanged heat with the heat exchanger using the first blower;

a second blower;

a second discharging port coupled to the second suction port by a second flow path separated from the first flow path and configured to discharge air from the housing using the second blower; and a discharging door having a plurality of discharging holes configured to discharge the heat-exchanged air from the first discharging port out of the air conditioner, wherein the second discharging port is selectively opened by a movement of the discharging door, wherein a discharge area of the first discharging port remains a constant size during the movement of the discharging door to selectively open and close the second discharging port, and wherein the air conditioner is configured to be selectively operated in a plurality of modes including:

a first mode where the first blower is operated to transfer air from the first suction port to the heat exchanger and transfer the heat exchanged air to the first discharging port at a first speed to be discharged from the air conditioner through the plurality of discharging holes at a second speed lower than the first speed, the second blower is idle, and the second discharging port is closed by the discharging door, a second mode where the first blower is idle, the second discharging port is opened by the discharging door, and the second blower is operated to transfer the air from the second suction port to be discharged from the air conditioner through the second discharging port at a third speed higher than the second speed, and a third mode where the first blower is operated to transfer air from the first suction port to the heat exchanger and transfer the heat exchanged air to the first discharging port at the first speed to be discharged from the air conditioner through the plurality of discharging holes at the second speed lower than the first speed, the second discharging port is opened by the discharging door, and the second blower is operated to transfer the air from the second suction port to be discharged from the air conditioner through the second discharging port at the third speed higher than the second speed so that the heat exchanged air discharged from the plurality of discharging holes at the second speed is mixed with room temperature air discharged from the second discharging port at the third speed to increase a discharge distance of the heat exchanged air from the air conditioner.

* * * * *